US006516166B2

(12) United States Patent
Sakakibara et al.

(10) Patent No.: US 6,516,166 B2
(45) Date of Patent: Feb. 4, 2003

(54) IMAGE FIXING APPARATUS

(75) Inventors: Hiroyuki Sakakibara, Chiba (JP); Shuji Moriya, Shizuoka (JP); Satoshi Nishida, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/961,141

(22) Filed: Sep. 24, 2001

(65) Prior Publication Data

US 2002/0061200 A1 May 23, 2002

(30) Foreign Application Priority Data

Sep. 28, 2000 (JP) ..... 2000-296813
Sep. 29, 2000 (JP) ..... 2000-300238

(51) Int. Cl.[7] ..... G03G 15/20
(52) U.S. Cl. ..... 399/69; 399/67
(58) Field of Search ..... 399/45, 67, 69, 399/70, 98, 99, 327, 328, 329; 219/216

(56) References Cited

U.S. PATENT DOCUMENTS

| | | | | |
|---|---|---|---|---|
| 5,148,226 A | | 9/1992 | Setoriyama et al. | |
| 5,162,634 A | | 11/1992 | Kusaka et al. | 219/216 |
| 5,210,579 A | | 5/1993 | Setoriyama et al. | |
| 5,262,834 A | | 11/1993 | Kusaka et al. | |
| 5,525,775 A | | 6/1996 | Setoriyama et al. | 219/216 |
| 5,742,865 A | * | 4/1998 | Yajima et al. | 399/69 X |
| 5,767,484 A | | 6/1998 | Hirabayashi et al. | 219/216 |
| 6,087,641 A | * | 7/2000 | Kinouchi et al. | 399/67 X |
| 6,094,559 A | * | 7/2000 | Otsuka et al. | 399/327 |
| 6,101,346 A | * | 8/2000 | Arakawa | 399/70 |
| 6,175,699 B1 | | 1/2001 | Kato et al. | 399/69 |

FOREIGN PATENT DOCUMENTS

| | | |
|---|---|---|
| JP | 63-313182 | 12/1988 |
| JP | 02-157878 | 6/1990 |
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |

* cited by examiner

*Primary Examiner*—Sandra Brase
(74) *Attorney, Agent, or Firm*—Fitzpatrick, Cella, Harper & Scinto

(57) ABSTRACT

An object of the present invention is to provide an image fixing apparatus for fixing an image formed on a recording material, which has a heating member, a back-up roller cooperating with the heating member to form a nip therebetween for conveying the recording material, and control device for controlling generation of heat by the heating member, wherein the control device is capable of effecting first control for permitting the heating member to generate heat in a state where an image fixing process is completed and the back-up roller is stopped, and second control for maintaining the heating member at a target temperature, differing from a fixing temperature, during a warm-up period from when the heating member starts to generate heat until the temperature of the heating member reaches the fixing temperature.

22 Claims, 22 Drawing Sheets

《AFTER FINISH OF PRE-ROTATION》
《TEMPERATURE CONTROL》

IMAGE FIXING APPARATUS

BACKGROUND OF THE INVENTION

1. Field of the Invention

The present invention relates to an image fixing apparatus mounted in an image forming apparatus, such as a copier or a printer.

2. Description of the Related Art

Thermal-roller image fixing apparatuses and on-demand image fitting apparatuses, well known conventional apparatuses, are mounted in image forming apparatuses, such as electrophotographic copiers and laser beam printers.

A thermal-roller image fixing apparatus includes a heating device and a pair of juxtaposed rollers (a fixing roller and a pressurizing roller), and when a recording sheet, such as paper, on which toner has been deposited is passed through a nip (a fixed portion), the point at which the rollers contact each other, the toner is melted and fixed to the sheet.

Of the pair of rollers, the fixing roller, which contacts the obverse surface of a sheet (the toner carrying side), is a hollow cylinder, the surface of which is composed of a material that exhibits a superior releasing property and is heated by an internally mounted halogen heater, the heating device, to melt the toner. The pressurizing roller, which contacts the rear face of the sheet, has an elastic layer formed on a core metal, and is appropriately pressed against the toner layer.

Ideally, applied heat melts all toner and fixes it to the surface of a sheet. However, when in the cold offset state there is, unmelted toner, or when in the hot offset state melted toner is heated excessively, toner (hereinafter referred to as stained toner) is electrostatically offset to the fixing roller, or this stained toner is fixed to the surface of either the fixing roller or the pressurizing roller, whichever roller has a surface that has an inferior releasing property.

When the releasing property of the fixing roller is inferior to that of the pressurizing roller, the stained toner is fixed to the fixing roller.

During image forming, however, the fixing roller is constantly heated to a toner melting temperature. Therefore, the stained toner is in the melted state, and since this toner is transferred to a sheet by being mixed with toner on the surface of the next sheet, a state wherein the fixing roller will be continuously contaminated is seldom present. However, there are conditions wherein stained toner is present on the surface of the fixing roller, and the staining of images may occur.

When the releasing property of the pressurizing roller is inferior to that of the fixing roller, stained toner that is offset to the fixing roller is moved to the pressurizing roller. The temperature of the pressurizing roller is lower than that of the fixing roller, and stained toner is not always present on the pressurizing roller in a state wherein it is completely melted.

Further, since the toner image on a sheet does not contact the pressurizing roller, the removal of stained toner with a toner image does not occur, and once the roller is contaminated, contamination toner continues to be accumulated.

Further, when the pressurizing roller continues to be contaminated with toner, the releasing property of the pressurizing roller is reduced. Thus, a sheet (especially an OHT film sheet) would stick to the pressurizing roller, or accumulated stained toner would be transferred at one time to the reverse side of the sheet, which is stained.

An on-demand image fixing apparatus enables a quick start and power reduction, compared with a thermal roll image fixing apparatus. Using the on-demand system, the thermal energy of the fixing apparatus is reduced by using a ceramic heater and a thin film, such as a polyimido film, so that a quick start and power reduction are implemented (Japanese Patent Application Laid-open Nos. 63-313182, 2-157878, 4-44075 to 4-44083 and 4-204980 to 4-204984).

Since the on-demand fixing apparatus requiring only a small amount of thermal energy and has a temperature response property, the fixing apparatus does not need to be warmed in advance, precise temperature control is available, and the supply of power to the fixing apparatus can be halted, except during the paper feeding time.

In the on-demand image fixing apparatus, however, under the above temperature control, the pressurizing roller is not heated except during the paper feeding time, so that the temperature is not easily raised, compared with the thermal roller system. The temperature of the pressurizing roller is raised only to 120° C., at most.

Therefore, stained toner that is offset to the fixing film and is shifted to the pressurizing roller tends substantially to be attached to the pressurizing roller, instead of being melted thereon.

When the feeding occurs of a recording material containing $CaCO_3$, the $CaCO_3$ is mixed with the offset toner, and the viscosity of the toner is reduced. Therefore, it is difficult to remove toner from the surface of the pressurizing roller, and contamination and deterioration of the pressurizing roller occurs.

To resolve this problem, in an image forming apparatus that has been proposed and has been put into use U.S. Pat. No. 6,175,699, fixing is halted after printing has been completed, and the heating member of the image forming apparatus is used to raise the temperature at a fixing nip until it is equal to or higher than the toner softening point (hereinafter referred to as "post-heating controls").

During this process, heat is produced by the heating member after the fixing apparatus has been halted, following the completion of the printing, toner attached to and accumulated on the pressurizing roller is melted at the fixing nip, and when the next printing sequence begins, the softened toner is shifted to the fixing roller or to the fixing film.

Then, when during the next fixing process a sheet is passed through the fixing nip, toner adhering to the fixing roller or the fixing film is transferred to the surface of the sheet, and the sheet, together with the added toner, is discharged.

The offset toner at this time has been accumulated through several to several tens of sheets were fed through. Therefore, the volume of the toner is too small to be recognized, and accordingly, the volume of the toner transferred to a sheet is too small to be noticed.

According to what is proposed above, on the outer face of the pressurizing roller, the portion that is stopped at the fixing nip after the printing is ended differs each time the pressurizing roller is halted. Therefore, by repeating the printing process, the contamination across the entire outer face of the pressurizing roller can be removed. As a result, the accumulation of contamination, such as toner, on the pressurizing roller can be prevented.

It has been found, however, that even when toner attached to the pressurizing roller is transferred to the fixing roller or to fixing film under post-heating control, toner is again transferred to the pressurizing roller during a preparation period for the initiation of the next fixing process. It has also been found that regardless of whether an image fixing apparatus is a heater roller type, a film type or an electromagnetic induction type, this toner re-transfer phenomenon easily occurs with an apparatus in which substantial heat is not applied to the fixing roller and the pressurizing roller is cool while the apparatus is on stand-by waiting for the transmission of a print signal.

SUMMARY OF THE INVENTION

To resolve the above shortcomings, it is one objective of the present invention to provide an image fixing apparatus that can remove offset toner.

It is another objective of the present invention to provide an image fixing apparatus that consumes little power and that can prevent a pressurizing roller from being contaminated.

It is an additional objective of the present invention to provide an image fixing apparatus that can prevent a pressurizing roller from being contaminated and that can provide a satisfactory fixing function.

It is a further objective of the present invention to provide an image fixing apparatus comprising:

a heating member;

a back-up roller cooperating with the heating member to form a nip therebetween for conveying the recording material;

control means, for controlling the generation of heat by the heating member and wherein the control means is capable of effecting first control for permitting the heating member to generate heat in a state where an image fixing process is completed and the back-up roller is stopped, and second control for maintaining the heating member at a target temperature, differing from a fixing temperature, during a warm-up period the heating member starts to generate heat until the temperature of the heating member reaches the fixing temperature.

It is a still further objective of the present invention to provide an image fixing apparatus comprising:

a heating member;

a back-up roller cooperating with the heating member to form a nip therebetween for conveying the recording material;

control means for controlling generation of heat by the heating member, wherein the control means is capable of effecting control for maintaining the heating member at a target temperature, differing from a fixing temperature, during a warm-up period from when the heating member starts to generate heat until the temperature of the heating member reaches the fixing temperature, and wherein the target temperature is a temperature such that, during a period where the heating member is maintained at the target temperature, 70% or more of the toner, which is remained on the heating member and is not transferred to the back-up roller, is present.

It is one more objective of the present invention to provide an image fixing apparatus comprising:

a heating member;

a back-up roller cooperating with the heating member to form a nip therebetween for conveying the recording material; and control means for controlling generation of heat by the heating member, wherein the control means is capable of effecting control for maintaining the heating member at a target temperature, differing from a fixing temperature, during a warm-up period from when the heating member starts to generate heat until the temperature of the heating member reaches the fixing temperature, and wherein 20% or more of the toner adhered to the heating member before a start of the warm-up period remains on the heating member at an end of the warm-up period.

The other objectives of the invention will become apparent during the course of the following detailed explanation, given while referring to the accompanying drawings.

DETAILED DESCRIPTION OF THE PREFERRED EMBODIMENTS

The preferred embodiments of the present invention will now be described while referring to the accompanying drawings.

First Embodiment (1) Example Image Forming Apparatus

Figure 1:
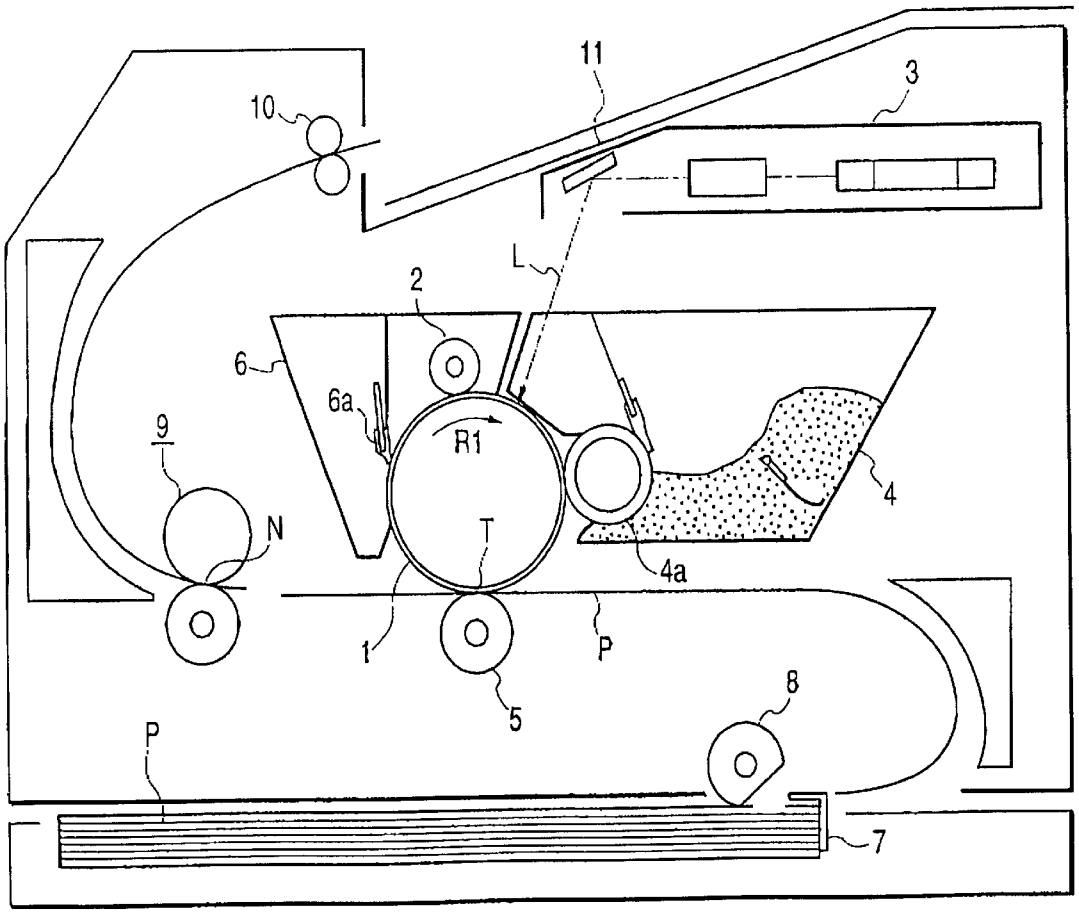
FIG. 1 is a schematic cross-sectional view of a printer comprising a fixing apparatus according to one of a first to a third embodiment of the present invention.

FIG. 1 is a schematic diagram (vertical cross-sectional view) specifically showing the configuration of an image forming apparatus that mounts a fixing apparatus according to the present invention, the image forming apparatus in this embodiment is a laser beam printer for a transfer type electrophotographic process.

The image forming apparatus comprises an electrophotographic photosensitive drum (hereinafter referred to as a "photosensitive drum") 1 as an image bearing member. The photosensitive drum 1 is rotatably supported by the apparatus, and is rotated by driving means (not shown) at a predetermined processing speed in the direction indicated by an arrow R1.

Disposed around the photosensitive drum 1, in the named order and in the direction of the rotation of the photosensitive drum 1, are a charging roller (electrifier) 2, exposing means 3, a developing apparatus 4, a transferring roller (transferring unit) 5, and a cleaning unit 6.

A paper cassette 7, in which recording materials P, such as paper sheets, are stored, is located under the image forming apparatus, and the recording material P is fed by paper feeding rollers 8. The recording material P is then passed through the transferring roller 5 and the fixing apparatus 9, and is discharged from discharge rollers 10 to a discharge tray 11.

More specifically, a uniform electric charge, having a predetermined polarity and a predetermined potential, is transferred by the charging roller 2 to the photosensitive drum 1, which is rotated by the driving means in the direction indicated by an arrow R1.

Based on image data, the laser optical exposure means 3 uses an exposure image L to expose the surface of the electrified photosensitive drum 1, and to form an electrostatic latent image thereon by removing the charge in those portions that are exposed.

The electrostatic latent image is then developed by the developing apparatus 4, which includes a developing sleeve 4*a*. Upon the application of a developing bias to the developing sleeve 4*a*, toner is transferred and adheres to the electrostatic latent image on the photosensitive drum 1, whereon a toner image is developed (visualized).

The toner image is transferred to the recording material P, such as paper, by the transferring roller 5. The recording material P, which is stored in the paper cassette 7, is fed from the paper feeding roller 8 and is conveyed to a transfer nip T between the photosensitive drum 1 and the transferring roller 5.

At this time, the leading edge of the recording material P is detected by a paper sensor (not shown) to synchronize the material P with the toner image on the photosensitive drum 1. Then, a transfer bias is applied to the transferring roller 5, and the toner image on the photosensitive drum 1 is transferred to a predetermined position on the recording material P.

The recording material P on which an unfixed toner image is deposited by the transfer process is conveyed to the fixing apparatus 9. At the fixing nip N. the unfixed toner image is heated and is fixed to the surface of the recording material P by pressure. This fixing apparatus 9 will be described later in detail in sub-division (2).

The recording material P to which the toner image has been fixed is discharged, by the discharge rollers 10, to the discharge tray 11 on the upper face of the apparatus.

After the toner image has been transferred, toner remaining on the photosensitive drum 1 that was not transferred to the recording material P is removed by a cleaning blade 6*a* of the cleaning unit 6, and the image forming apparatus is prepared for the next image forming process.

By repeating the above described processing, images can be formed sequentially.

(2) Fixing Apparatus

Figure 2:
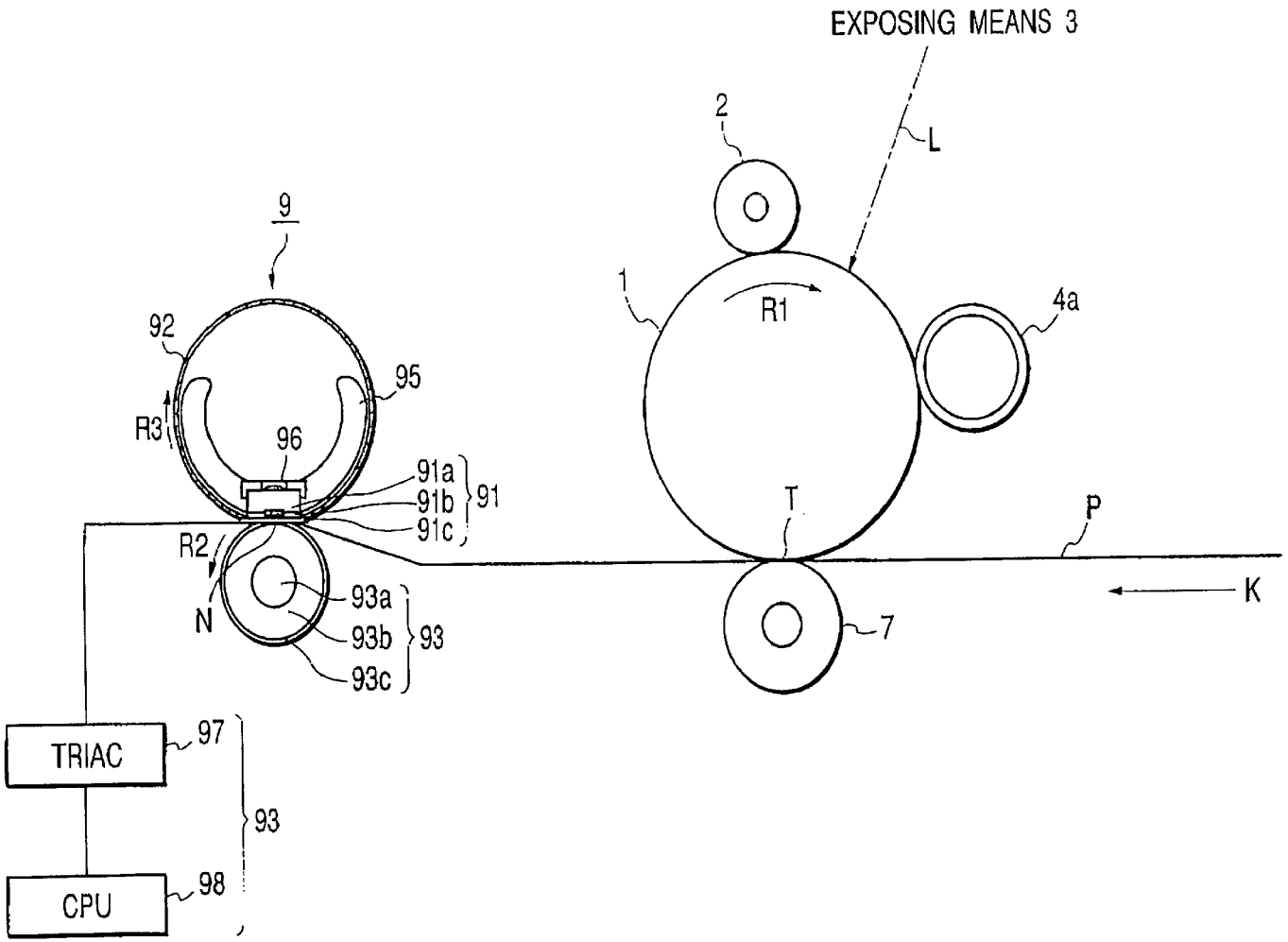
FIG. 2 is a schematic cross-sectional view of the configuration of the fixing apparatus according to one of the first to the third embodiments of the present invention.

The fixing apparatus 9 in this embodiment will be described in detail while referring to FIG. 2. The fixing apparatus 9 in this embodiment is, for example, an on-demand fixing apparatus of a film-heating and pressurizing roller-driving type that is disclosed in Japanese Patent Application Laid-open Nos. 4-44075 to 4-44083. The recording material P is conveyed in the direction indicated by an arrow K.

The fixing apparatus 9 primarily comprises: a ceramic heater (hereinafter referred to simply as a heater) 91, which is a heating member for heating toner; a cylindrical fixing film (hereinafter referred to simply as a film) 92, which encloses the heater 91; a pressurizing roller 93, which contacts the film 92; and temperature control means 94, for controlling the temperature of the heater 91.

The heater 91 is so designed that a resister pattern 91*b* is formed on a heat-resistant-base material 91*a*, such as aluminum, by printing, for example, and the surface of the structure is covered with a glass material 91*c*. The heater 91 is wider than the recording material P in the direction perpendicular to the direction in which the recording material P is conveyed (the direction indicated by the arrow K).

The heater 91 is supported by a heater holder 95 attached to the main body of the apparatus. The heater holder 95 is a semi-circular member made of a heat-resistant resin, and also serves as a guide member for guiding the rotation of the film 92.

The film 92 is cylindrically formed of a heat-resistant resin, such as polyimido, having an outer diameter of 24 mm, and is fitted around the heater 91 and the heat holder 95. The film 92 is pressed against the heater 91 by the pressurizing roller 93, which will be described later, and the rear face is brought into contact with the lower face of the heater 91. A fixing nip N is a contact portion formed by the heater 91 and the pressurizing roller 93 with the film 92 sandwiched between them.

The pressurizing roller 93 is rotated by drive means (not shown) in the direction indicated by an arrow R2. As the pressurizing roller 93 is rotated in the direction indicated by the arrow R2, the recording material P is conveyed in the direction indicated by the arrow K, and accordingly, the film 92 is rotated in the direction indicated by an arrow R3.

Both ends of the film 92 are regulated by the guide portion (not shown) of the heat holder 95 to prevent the film 92 from being shifted in the longitudinal direction of the heater 91.

Further, a coating of grease is applied to the internal wall of the film 92 to reduce the resistance to sliding between the heater 91 and the heater holder 95.

The pressurizing roller 93 has an outer diameter of 20 mm, and includes a metal core 93*a*; a heat-resistant elastic layer 93*b*, which is composed of silicon rubber, for example, and which is formed on the outer wall of the core 93*a*; and a releasing layer 93*c*, which is made of fluorocarbon resin and which has superior heat resistance and releasing properties. The pressurizing roller 93 presses the film 92 against the heater 91 from below, and with the film 92 forms the fixing nip N. The width (nip width) of the fixing nip N in the direction in which the pressurizing roller 93 is rotated is so set that the toner on the recording material P can be appropriately heated and pressurized.

The temperature control means 94 includes a thermistor (temperature detection element) 96, which is attached to the rear face of the heater 91; a triac 97; and a CPU 98, which controls the triac 97 based on the temperature detected by the thermistor 96, and controls the supply of power to the heater 91.

As is described above, in the fixing apparatus 9, as the pressurizing roller 93 is rotated in the direction indicated by the arrow R2, the recording material P is conveyed while clamped at the fixing nip N, and the toner on the recording material P is heated by the heater 91. At this time, the temperature control means 94 controls the supply of power to the heater 91 to maintain the fixing temperature at the thermistor 96.

For the image forming apparatus of this embodiment, the revolution of the pressurizing roller 93 is set at 0.9 rps (radian per second), and the elapsed time from when the supply of power to the heater 91 is begun until the recording material P enters the fixing nip P is 9 seconds (3) Fixing Control Sequence The fixing control sequence of this embodiment will now be described in detail.

a) Post-heating Control

Figure 3:
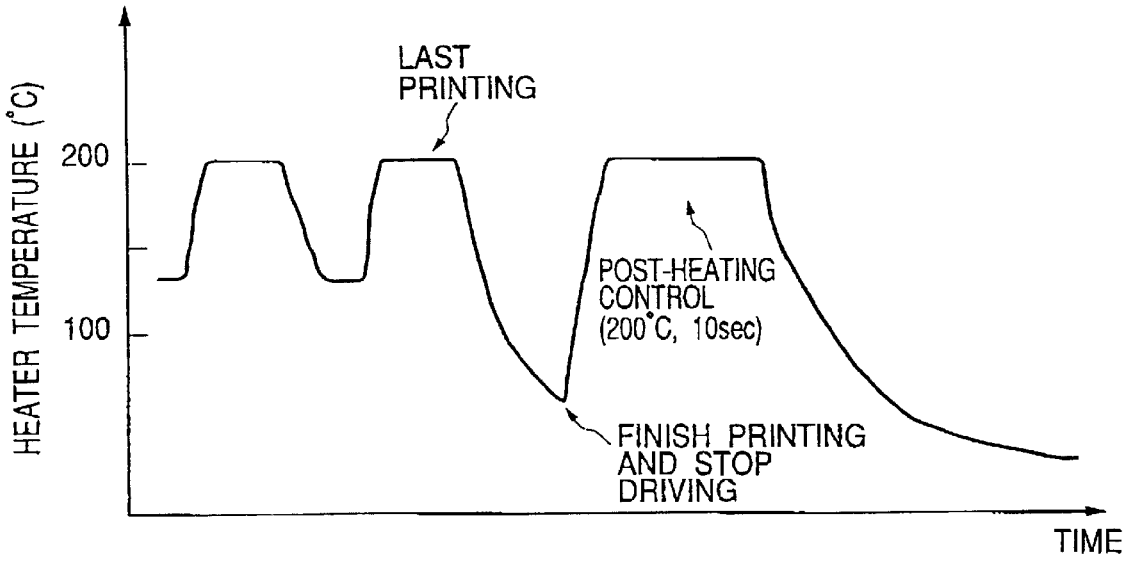
FIG. 3 is a graph showing the relationship between time and the temperature of a heater that is used to explain post-heating control (first control)

First, post-heating control, which is the first control exercised, will be explained while referring to FIG. 3. When, after printing has been completed, the apparatus is halted, the temperature at the fixing nip N is elevated until it is equal to or higher than the toner softening temperature, and the offset toner adhering to the film 92 and the pressurizing roller 93 are combined at the fixing nip N, following which the obtained toner is transferred to the film 92.

Figure 4:
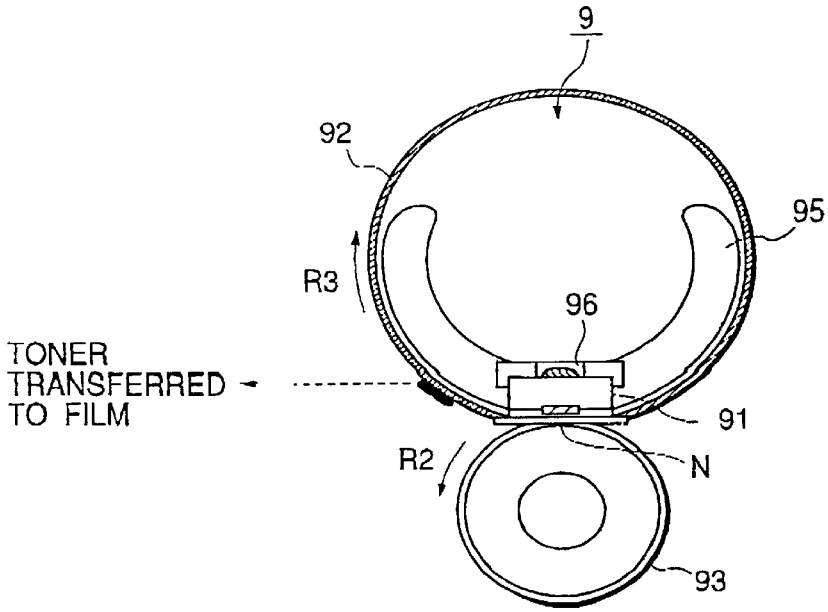
FIG. 4 is a diagram showing the state wherein. under post-heating control, toner on a pressurizing roller has been transferred to a film, to which it has adhered, and is moved as the film is rotated.

In this embodiment, temperature control is exercised to provide a temperature of 200° C. in ten seconds, while the film 92 and the pressurizing roller 93 are halted. During this time, while waiting for the next print signal, the toner is softened, and immediately after the film 92 and the pressurizing roller 93 are driven at the start of printing, the softened toner is transferred to the fixing film 92 (see FIG. 4).

Pre-rotation temperature control will now be described as the second control process. For this control process, the temperature of the heater 91 is controlled so that "stained toner", consisting of particles, too tiny to be identified, that were transferred to the film 92 under post-heating control, will not be re-transferred to the pressurizing roller 93 while preparations for the next fixing process are being made.

b) Pre-rotation Temperature Control

The pre-rotation temperature control sequence, the second control process, will be described while referring to FIG. 5.

First, immediately after a print signal is received, the supply of power to the heater 91 and the driving of the motor are initiated simultaneously. A first target temperature T1 of 120° C. is set and is maintained for a predetermined time, in this embodiment, 8 seconds (to a time one second before the recording material P enters the fixing nip N) following the power supply initiation (the driving of the motor is begun).

Eight seconds after the supply of power is begun, i.e., one second before the recording material P enters the fixing nip N, the temperature is changed to the second target control temperature T2, which in this embodiment is 220° C., that is required to fix the toner.

Figure 6:
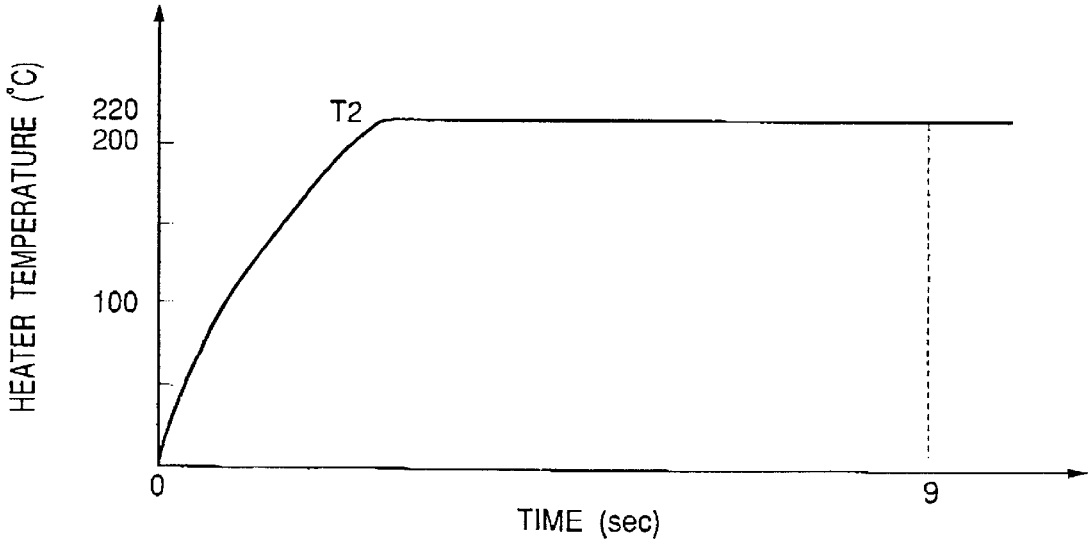
FIG. 6 is a graph showing the relationship between time and the temperature of a heater that is used to explain the conventional pre-rotation temperature control.

In the conventional pre-rotation control sequence, the supply of power is also begun immediately after a print signal is received. However, during the process, control is not performed step by step, and immediately after the supply of power is begun, the temperature is changed to the temperature T2, which is required to fix toner (FIG. 6).

An explanation will now be given for the evaluation results obtained in a case wherein, through the conventional pre-rotation temperature control sequence, toner is transferred to the film 92 under post-heating control following the completion of the preceding fixing process, and the amount of toner maintained thereon is examined.

The evaluation method is as follows.

Figure 7:
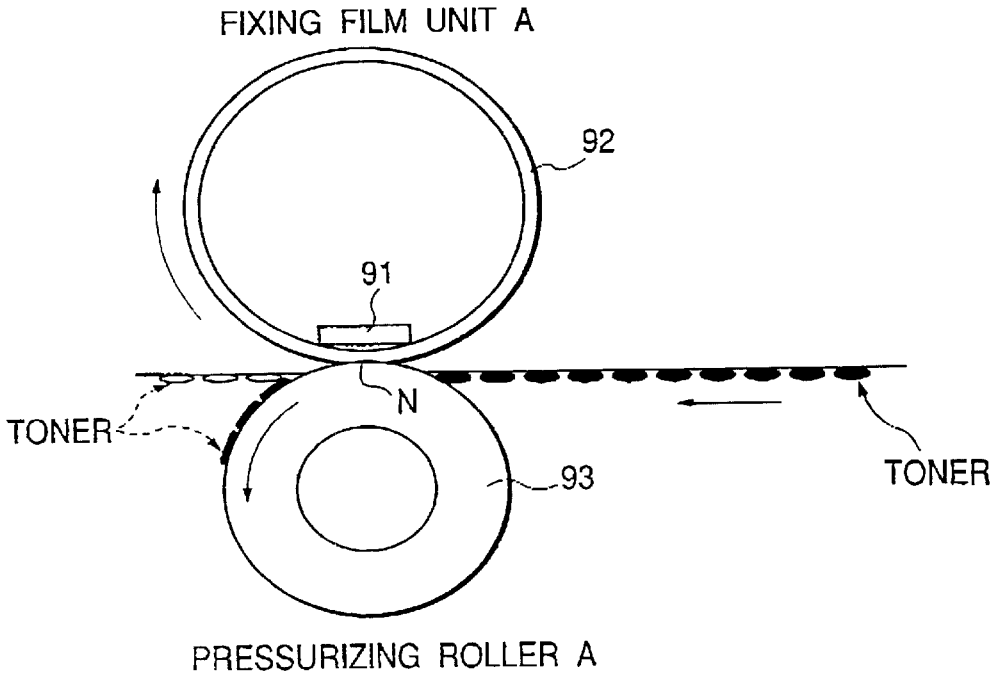
FIGS. 7 to 11 are diagrams showing the process used to measure the rate whereat toner transferred from the pressurizing roller to the film is retained on the film instead of being re-transferred to the pressurizing roller.

1) The recording sheet P on which an unfixed image of a halftone pattern (a printing rate of 40%) is printed is reversed, so that the image bearing side contacts the pressurizing roller 93, not the film 92, and is passed through the fixing nip N. At this time, a fixing film unit A and a pressurizing roller are employed (FIG. 7).

Figure 8:
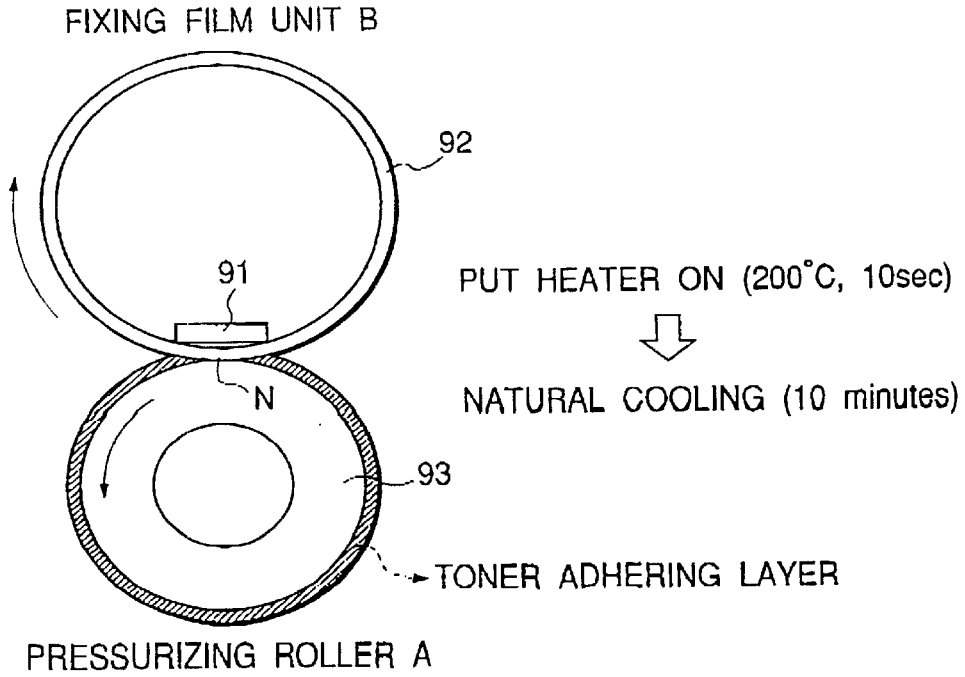

2) When the fixing-film unit A for evaluation and the pressurizing roller A to which toner is adhered are assembled, and when the temperature of the toner softening point is set to T0, the heating temperature is controlled while the heater is halted for a period of 10 seconds at a temperature of T0×1.4 (° C.). Thereafter, the heater is naturally cooled until the heater temperature is returned to normal. In this embodiment, since T0=140° C., the controlled temperature at the heater is 200° C. (FIG. 8).

Figure 12:
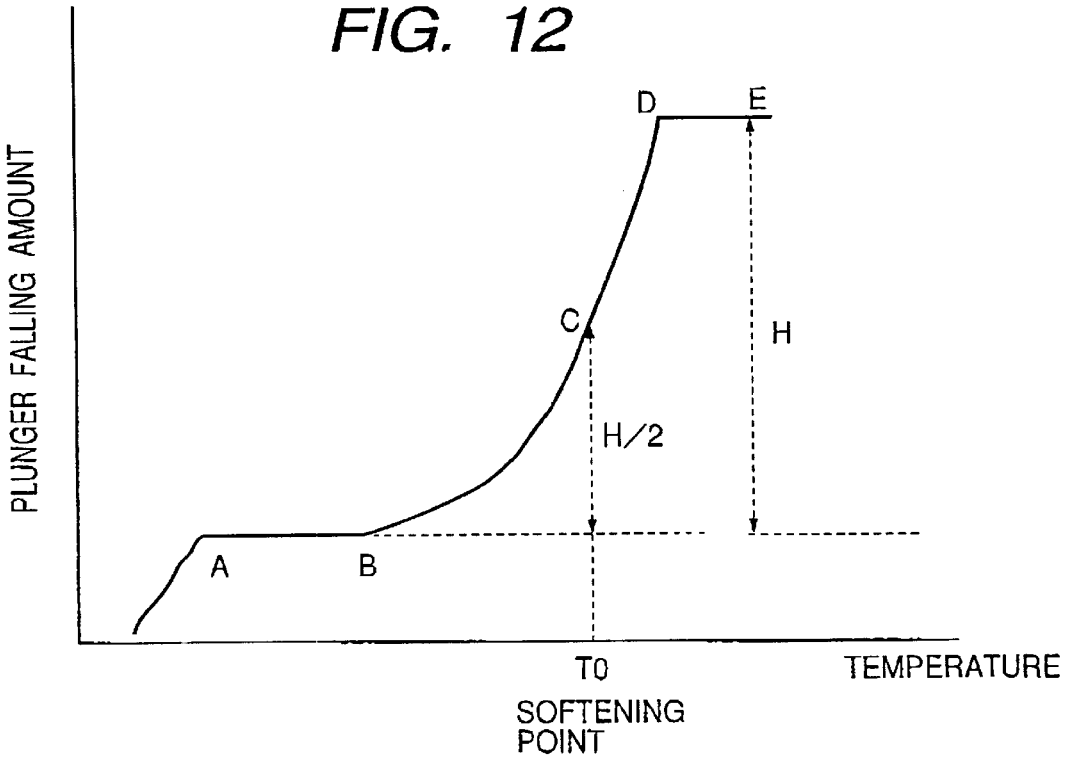
FIG. 12 is a graph for explaining the definition of the softening point of toner.

In this embodiment, the temperature at the toner softening point is defined as follows. Specifically, a Flow Tester CFT-500 (Shimadzu Corporation) is employed, and a 1.0 g sample produced by a pressure molding device is heated to an initially set temperature of 50° C. for a pre-heating period of 300 seconds. Then, a plunger is used to extrude the sample through a nozzle having a diameter of 1 mm and a length of 1 mm at a temperature elevating speed of 5.0° C. min under a load of 2.0 N (about 20 kgf). Thus, the plunger failing amount of the Flow Tester is measured. In accordance with the curve between the plunger falling amount of the Flow Tester and the temperature (see Flow Tester flow-out curve in FIG. 12), as the temperature is raised at a constant speed, the toner is gradually heated and the sample begins to flow (plunger falling amount A to B). At this time, the temperature at the sample flow-out start point is defined as that at the flow-out start point (B). When the temperature is elevated further, the toner flows out rapidly (B to C to D), until the plunger falling is halted and the flow levels off (D to E). When the current height along the S-shaped curve is defined as H, the temperature T0, corresponding to point C at height H/2, is defined as the toner softening point temperature.

Figure 9:
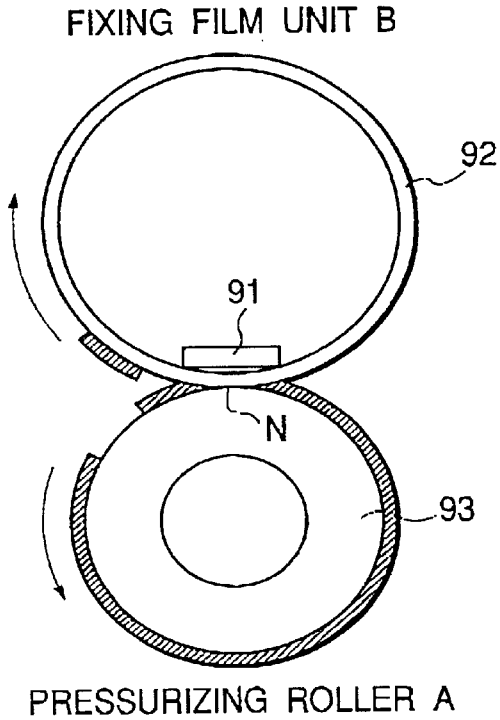

3) The nip N is changed to provide a state wherein stained toner at the nip N is transferred to the fixing film unit B (FIG. 9).

Figure 10:
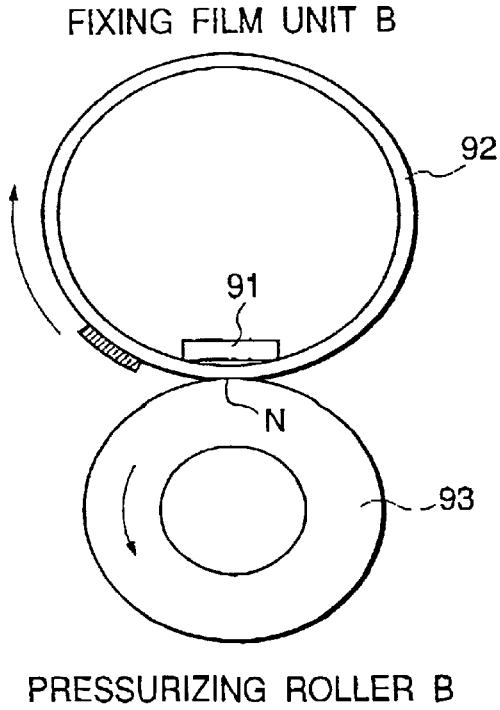
Figure 11:
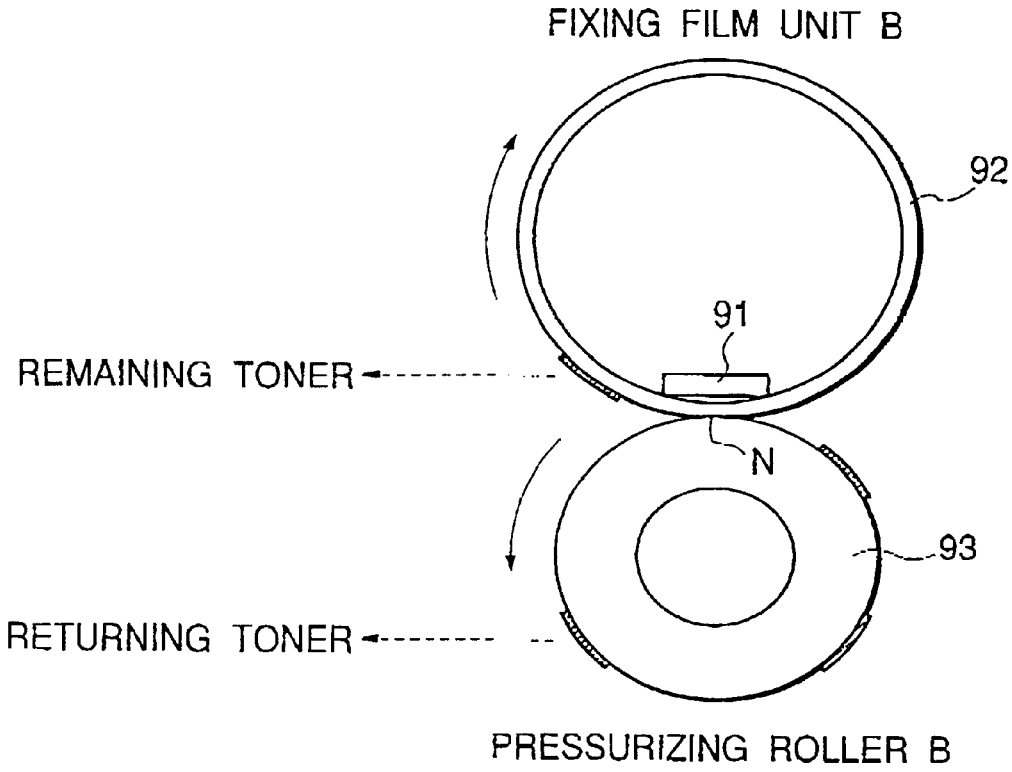

4) For evaluation, a fixing film unit B and a pressurizing roller B are mounted in the image forming apparatus, and are halted after the pre-rotation temperature control is terminated (immediately before the recording material P enters the fixing nip N). Since depending on the image forming apparatus the pre-rotation temperature control time differs, the time is set for the image forming apparatus that is used. For the pre-rotation temperature control in this embodiment, the time set is nine seconds (FIGS. 10 and 11).

5) From the portion of the film 92 to which stained toner adhered; the remaining toner is transferred to the paper. That is, the pertinent portion of the film 92 is set to the nip N, and while the film 92 is halted, for ten seconds it is heated at T0×1.4=200 (° C.).

6) The reflectivity D1 of the remaining toner that has been transferred to paper is measured by a Macbeth densitometer (MacbethRD914).

7) The density D2 of the toner adhering to the fixing film in the initial state that is prepared at step 3) is measured in the manner described in 5) and 6). The densities D1 and D2 are re-calculated to obtain the reflectivities R1 and R2.

8) The toner remaining rate a is calculated as $\alpha=(R1/R2)\times 100$.

The toner remaining rate measured by the above method is 0 when the conventional pre-rotation temperature control sequence (FIG. 6) is employed. In other words, the stained toner, which was transferred to the film 92 under post-heating control, is all returned to the pressurizing roller 93 while pre-rotation temperature control is employed.

This is because, when the heater 91 is electrified to rapidly elevate the temperature thereof to the fixing temperature, a drastic temperature inclination occurs between the film 92 and the pressurizing roller 93, and toner adhering to the film 92 is gradually returned to the pressurizing roller at a lower temperature.

If the sheet is conveyed to the fixing nip N before the amount of returning toner that is transferred to the film 92 from the pressurizing roller 93 is increased, and so long as toner particles too tiny to be identified can be projected onto the surface of the sheet (the film side), the pressurizing roller 93 can be protected from being contaminated with toner.

When the volume of toner being returned to the pressurizing roller 93 is increased, the amount of offset toner increases until it is equal to or greater than the amount of stained toner that is transferred from the pressurizing roller 93 to the recording paper P. As a result, the toner is deposited on the pressurizing roller 93.

The factors involved in varying the volume of the toner that is returned from the film 92 to the pressurizing roller 93 can be the properties of the toner, the control temperature of a heater, the pre-rotation temperature control time and the revolutions of a pressurizing roller 93.

Figure 13:
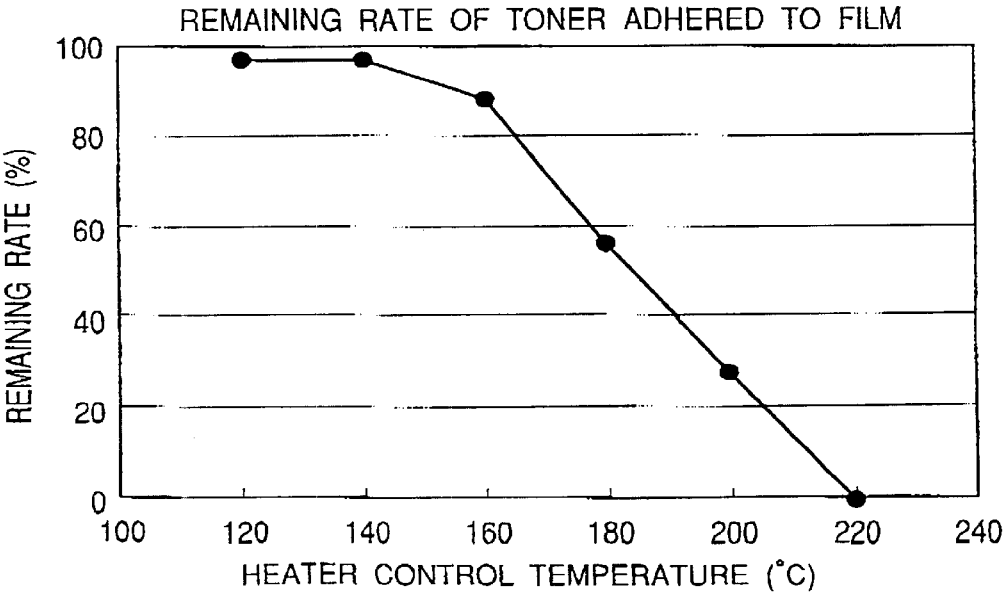
FIG. 13 is a graph showing the relationship between the heater control temperature and the remaining ate of the toner adhered to the film.

The relationship between the toner returning to the pressurizing roller 93 and the control temperature is shown in FIG. 13. According to the evaluation method employed in this case, the pre-rotation temperature control sequence was not exercised step by step, but instead, the temperature was raised to the control temperature (target temperature) immediately after electrification was begun, as in the conventional case. The evaluation was effected by raising the target temperature from 120° C. to 220° C., and setting the pre-rotation temperature control time to nine seconds, for either temperature control. The vertical axis represents the rate at which the toner remained on the film 92, a higher value meaning that more toner remained on the film 92. That is, the toner can be easily projected onto the surface of the recording paper, without being deposited on the pressurizing roller.

As is shown in FIG. 13, it is apparent that if the control temperature is equal to or lower than 140° C., i.e., equal to or lower than the toner softening point, almost 100% of the stained toner transferred to the film 92 can be retained thereon.

The toner remaining rate for the two-step pre-rotation temperature control process (see FIG. 5) used in the first embodiment was 33%. This is because, since the temperature was changed to 220° C. eight seconds after the supply of power was started, the amount of toner returning thereafter to the pressurizing roller 93 was increased.

However, as is apparent from the above discussion, in the pre-rotation temperature control process, when following the start of electrification a specific temperature is maintained for eight seconds to inhibit the return of stained toner from the film 92 to the pressurizing roller 93, and when the temperature is raised to the fixing temperature T2 immediately after the recording material P enters the fixing nip N, it is possible through the post-rotation control process constituting the first control to prevent the return of toner from the film 92 to the pressurizing roller 93 and to completely remove the stained toner from the pressurizing roller 93. Actually, not only is the toner removed from the path that is currently being explained, but also, while paper is being fed, a slight amount of toner may be directly transferred from the pressurizing roller 93 to the rear face of the recording material.

Further, through the two-step pre-rotation temperature control process, as in the feast embodiment, not only can the pressurizing roller 93 be cleaned completely, but also defects, such as a fixing failure, do not occur.

In order to confirm the effects provided by the cleaning of the pressurizing roller 93, the contamination of the pressurizing roller 93 was evaluated when a character pattern was printed in a low temperature, low humidity environment. The discussion results are as follows.

TABLE 1

| | |
|---|---|
| conventional pre-rotation temperature control sequence | contamination of pressurizing roller occurring when number of printed sheets is 500 |
| pre-rotation temperature control sequence in this embodiment | no contamination of pressurizing roller when number of printed sheets is 50000 |

The results of a comparison of the fixing capability of the embodiment and the conventional capability.

TABLE 2

| | density reduction rate |
|---|---|
| conventional control | 16% |
| first embodiment | 16% |

Evaluation of fixing capability: a black pattern 5 mm square is printed and fixed and the image is overlapped with a paper sheet and rubbed using a weight of 0.03 N (about 300 gf) and a contact area of 30 mm×30 mm. The densities before and after the rubbing are measured to obtain the density reduction rate, and the lower the density reduction rate, the higher the fixing capability. As is apparent from Table 2. using the pre-rotation temperature control, as in the first embodiment, the fixing property was the same as that provided by the conventional control, and no problems occurred.

As is described above, since the pre-rotation control sequence in the first embodiment is used, the contamination of the pressurizing roller can be prevented.

Further, through discussion it was determined that even when all factors, such as the toner property, the pre-rotation temperature control time, the revolutions of the pressurizing roller and the heater control temperature, are regarded as requisite elements, they need only be set under the following conditions, so that the contamination of the pressurizing roller can be consistently prevented.

Assume that t1 (nine seconds in this embodiment) denotes the pre-rotation temperature control time and that T1 denotes the control temperature whereat the remaining rate for the stained toner adhering to the film 92 is equal to or greater than 70%. Then, when the temperature is controlled one time at T1 or lower at a time t2, for which $t2 \geqq t1 \times 0.4$ is established relative to time t1, the contamination of the pressurizing roller 93 can be prevented.

Figure 14:
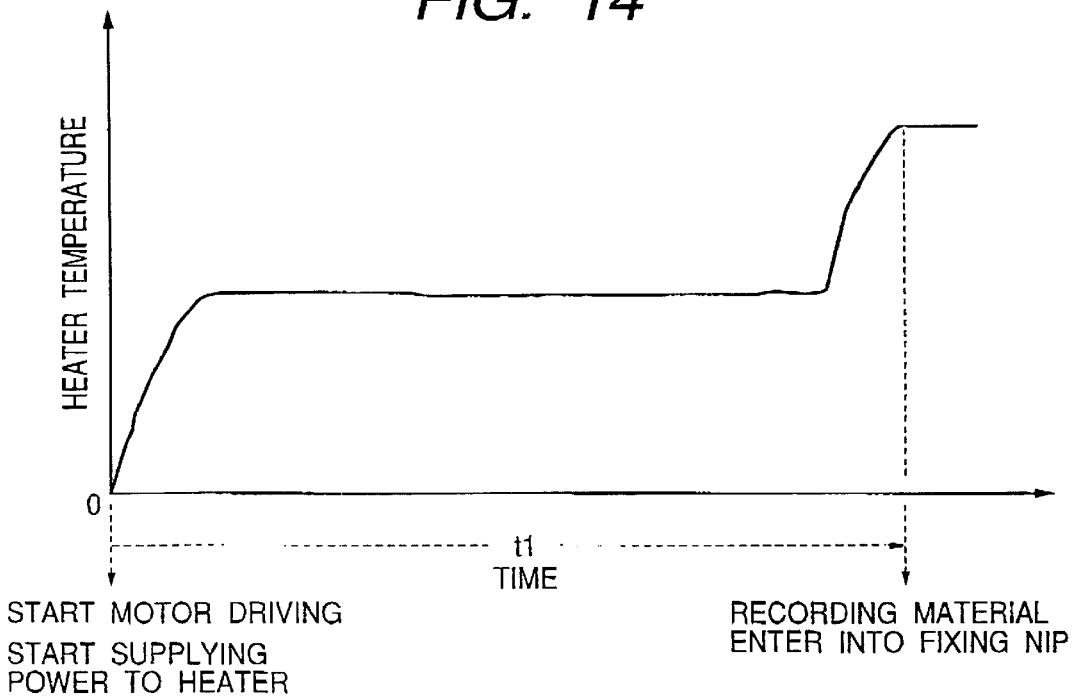
FIG. 14 is a graph showing the start timing and the end timing for the pre-rotation temperature control.

The pre-rotation temperature control time t1 is defined as a period between the time a motor is driven following the receipt of a print signal until a recording material P sheet enters the fixing nip N. When the time for beginning the driving of the motor differs from the time the electrification of the heater 91 is begin, the earlier time is defined as a base. point (FIG. 14).

The constant temperature T1, whereat the stained toner remaining rate is equal to or greater than 70%, is T1 (170° C. in the first embodiment in FIG. 13.

The time t2 is $t2 \geqq 9 \times 0.4 = 3.6$ seconds in the first embodiment.

Figure 15:
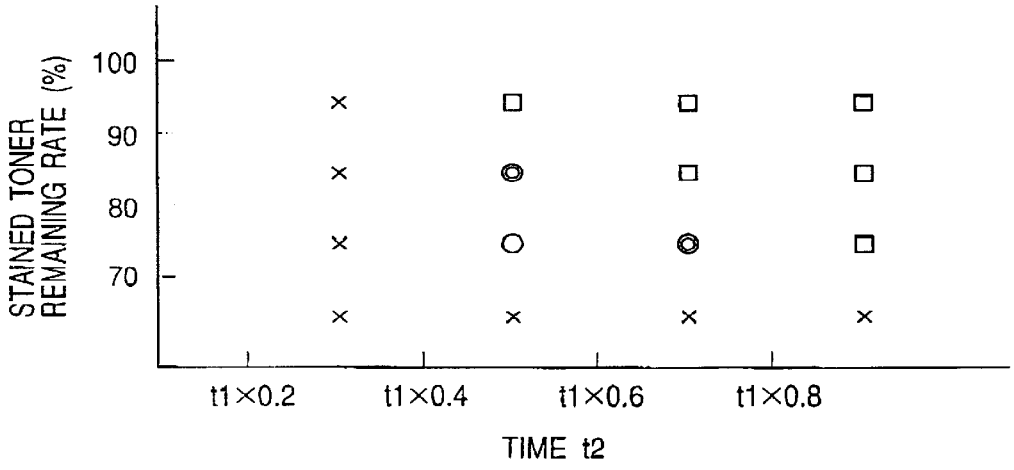
FIG. 15 is a graph showing the toner remaining rate when time t2 controlled at temperature T1 is changed; a FIG. 16 is a graph showing the pre-rotation temperature control when the rotation of the pressurizing roller is begun, and then, the supply of power to the heater is started.

FIG. 15 is graph showing the effects on the contamination of the pressurizing roller for the stained toner remaining rate and the time t2.

When T1 is set as the control temperature whereat the remaining rate for the stained toner adhering to the film 92 is less than 70%, and or when the control time t2 is set to $t2 < 0.4 \times t1$ while a temperature is set whereat the remaining rate is equal to or greater than 70%, as is shown in FIG. 15, there is almost no effect on the contamination of the pressurizing roller. For the second case, the control time at the temperature T1 is so short that the stained toner is returned to the pressurizing roller 93 during the pre-rotation temperature control process.

It is necessary for a temperature T1 to be set whereat the remaining rate for the stained toner is equal to or greater than 70%, or is preferably 80%, or even more preferably is 90%.

It is necessary for the control time t2 at the temperature T1 to be set as $t2 \geqq 0.4 \times t1$, relative to the time t1 that extends from the time temperature control is begun until the recording material P enters the fixing nip N, and is preferably $t2 \geqq 0.6 \times t1$, and even more preferably is $t2 \geqq 0.8 \times t1$.

As is described above, it is apparent that so long as at least 70% of the toner remains on the surface of the film 92 for the time t2 in which the temperature T1 is maintained for the heater, no toner is deposited on the pressurizing roller 93. In accordance with a further discussion by the present inventors, it was determined that when the pre-rotation temperature control is set overall so that the remaining rate for the stained toner on the film 92 is equal to or greater than 20%, the contamination of the pressurizing roller can be prevented. Further, the stained toner remaining rate (in the first embodiment, the remaining rate after nine seconds have passed) before and after the total pre-rotation temperature control time t1 (period extending from the time the electrification of the heater is begun until the temperature reaches the fixing temperature) expires is set no it is equal to or greater than 20%.

An explanation will now be given for the relationship between the remaining rate for the stained toner adhering to the film 92, before and after the total pre-rotation temperature control time t1 expires, and the contamination of the pressurizing roller. The temperatures T1 and T2 and the times t1 and t2 were changed as needed to alter the stained toner remaining rate, and the same results were obtained.

TABLE 3

| Stained toner remaining rate | contamination of pressurizing roller |
|---|---|
| 5% | ● |
| 10% | ● |
| 15% | x |
| 20% | ○ |
| 25% | ○ |
| 30% | ◎ |
| 35% | □ |
| 40% | □ |

● a stain occurred while printing when 500 copies
x a stain occurred while printing 1000 copies
○ a very tiny stain occurred while printing 10000 copies
◎ a very tiny stain occurred while printing 30000 copies
□ no stain occurred while printing 50000 copies As is described above, the effects relative to the contamination of the pressurizing roller can be obtained when a remaining rate equal to or greater than 20% is set for the stained toner adhering to the film 92 before and after the total pre-rotation temperature control time T1 expires.

When the remaining rate was equal to or smaller than 10%, the pressurizing roller was stained while feeding 500 sheets. And when the remaining rate was equal to or smaller than 15%, the pressurizing roller was stained while feeding 1000 sheets.

At the remaining rates of 20% and 25%, only several tiny toner particles were attached to the pressurizing roller, and this did not adversely affect the actual printing. Further, at the remaining rate of 30%, only several tiny toner particles were adhered to the pressurizing roller, and this did not adversely affect the actual printing. At the remaining rate equal to or greater than 35%, no stain was found on the pressurizing roller while feeding 50000 sheets.

In the first embodiment, the post-heating control sequence is initiated after the printing is terminated and the motor is halted. This is because the toner transfer to the film 92 is ensured.

However, when a high temperature is supplied for the fixing unit, the same effects can be obtained merely by halting the motor, without the post-heating control sequence being required. That is, the post-heating control sequence may be turned off as needed.

Figure 5:
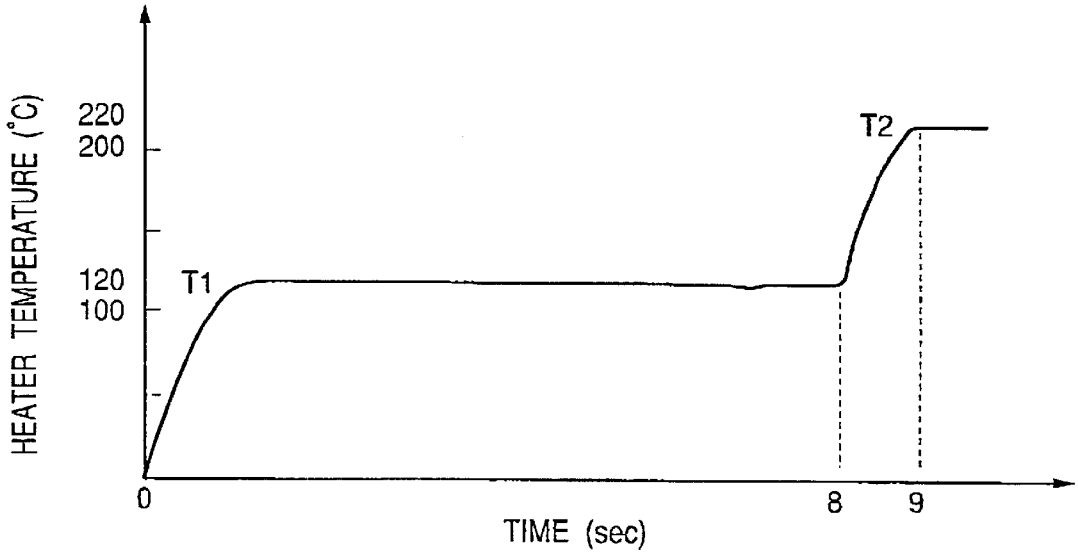
FIG. 5 is a graph showing the relationship between time and the temperature of a heater that is used to explain the pre-rotation temperature control (second control)
Figure 16:
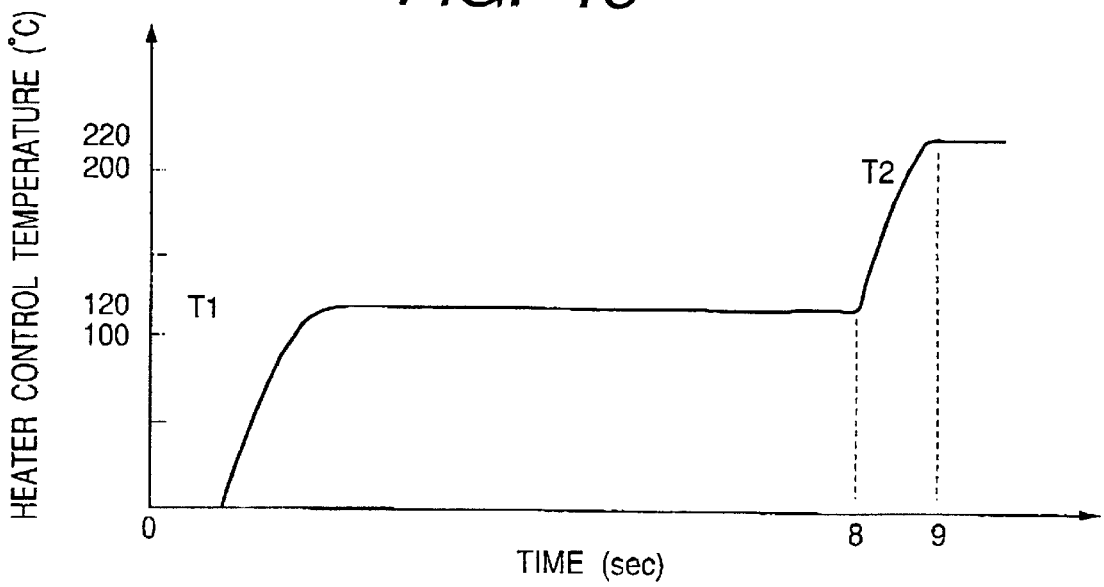

In this embodiment, the heater 91 is electrified at the same time as the motor is driven (FIG. 5). When the electrification is initiated after the driving of the motor has begun, the amount of stained toner that returns to the pressurizing roller 93 can be reduced, and the satisfactory effects relative to the contamination of the pressurizing roller 93 can be obtained (FIG. 16).

The on-demand image forming apparatus has been described in detail; however, the present invention can be used for a thermal roller image forming apparatus.

Second Embodiment

Figure 17:
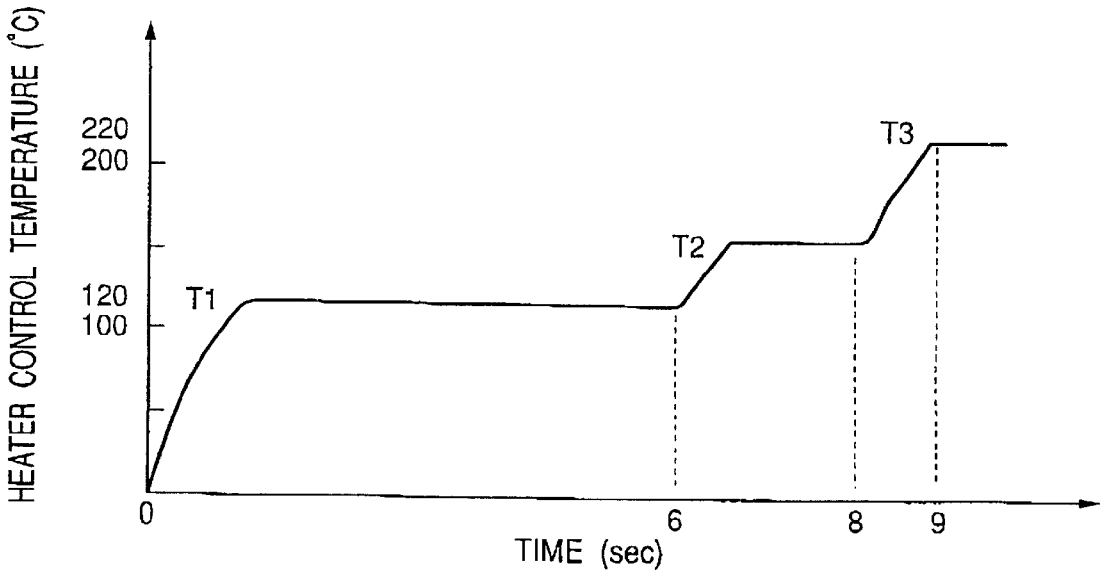
FIG. 17 is a graph showing the pre-rotation temperature control according to a second embodiment.

The pre-rotation temperature control sequence for a second embodiment will now be described. In this embodiment, the pre-rotation temperature control sequence is performed in three stages (FIG. 17).

First, immediately after a print signal is received, electrification of a heater 91 is begun at the same time as the driving of a motor.

At this time, a first target control temperature T is set to 120° C., and 120° C. is maintained for six seconds following the start of the electrification (following the time at which the motor was started).

Then, a second target-control temperature T2 of 160° C. is maintained for a period (two seconds) extending from six seconds to eight seconds following the start of the electrification.

Following this, eight seconds following the start of the electrification, i.e., one second before a recording material P sheet enters a fixing nip N, the second temperature is changed to a third target control temperature T3 that is required to fix the toner. In this embodiment, the temperature T3 is 220° C.

In this pre-rotation temperature control sequence, compared with the first embodiment, the amount of the stained toner that is transferred to the film 92 and is returned to the pressurizing roller 93 is increased.

However, since the amount of heat supplied to the fixing unit (the fixing film unit and the pressurizing roller 93) is increased, the temperature of the fixing unit can be increased.

The pre-rotation temperature control sequence is effective for paper, such as cardboard or an envelope, that has a inferior fixing property. For example, when a user designated cardboard or an envelope by using a personal computer, or when the printer detects cardboard or an envelope, the pre-rotation temperature control sequence in the second embodiment is performed. For other paper types, the pre-rotation temperature control sequence in the first embodiment is performed.

When the temperature of the pressurizing roller 93 was measured for the pre-rotation temperature control sequences in the first and second embodiments, 80° C. was obtained for the sequence in the first embodiment, while 86° C. was obtained for the sequence in this embodiment. These values are those measured after nine seconds have elapsed following the start of the electrification in the normal temperature state.

The results obtained by comparing the fixing capabilities in both sequences are as follows. The testing method is performed in the same manner as in the first embodiment.

TABLE 4

| | Density reduction rate |
|---|---|
| First embodiment | 16% |
| Second embodiment | 12% |

As is described above, when the pre-rotation temperature control sequence of the second embodiment is employed, the toner adhering to the film is prevented from being transferred to the pressurizing roller, and the fixing capability can be improved.

The contamination of the pressurizing roller 93 is evaluated as in the first embodiment. A little toner adhered while printing 30000 copies; however, this did not actually adversely affect the printing.

In the second embodiment, the remaining rate for the stained toner adhering to the film before and after the expiration of the total pre-rotation temperature control time t1 was 30%.

As is described above, when the time for changing the control temperature in the pre-rotation temperature control sequence is adjusted appropriately. contamination of the pressurizing roller is prevented while the fixing capability is improved.

So long as the time and the relationship of the remaining rate for the stained toner adhering to the film, as explained in the first embodiment, are satisfied, an arbitrary number of stages may be set for the pre-rotation temperature control sequence.

Furthermore, in the second embodiment, the post-heating control process may be removed as needed, as in the first embodiment.

Further, when the electrification is started after the driving of the motor has begun, as in the first embodiment, the amount of stained toner returned to the pressurizing roller 93 can be reduced.

In addition, also as in the first embodiment, the present invention can be applied for the thermal roller image forming apparatus.

Third Embodiment

In a third embodiment, the same configuration as in the first embodiment is employed, except for the pre-rotation temperature control sequence.

Figure 18:
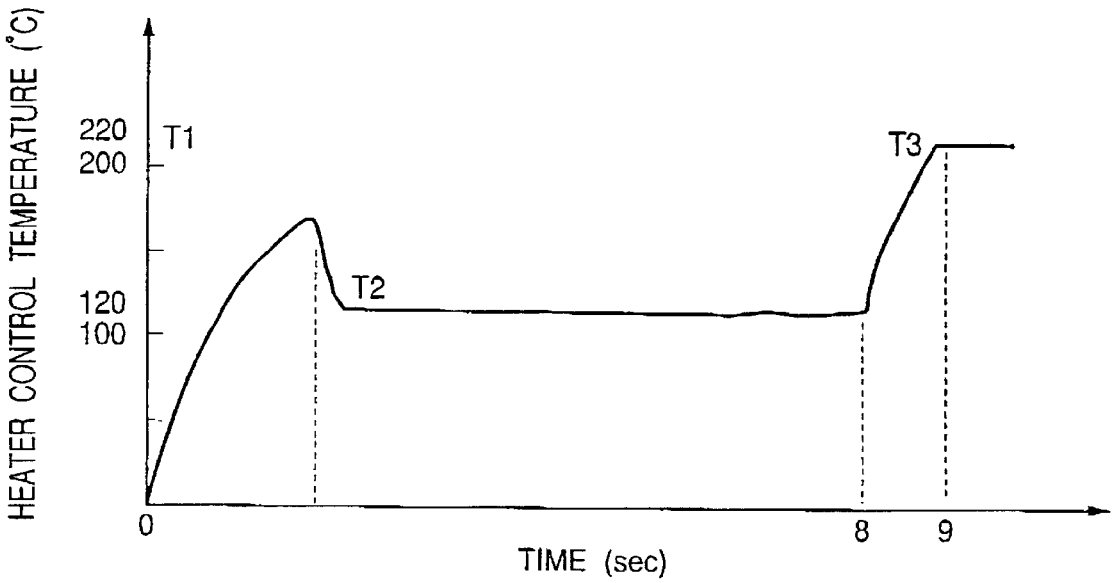
FIG. 18 is a graph showing the pre-rotation temperature control according to a third embodiment.

The pre-rotation temperature control sequence will now be described. In the third embodiment, a three stage pre-rotation temperature control sequence, as shown in FIG. 18, is employed.

First, immediately upon receiving a print signal, the electrification of a heater 91 is begun at the same time as is the driving of the motor.

In this process, a first target control temperature T1 of 220° C. is set, and during a two-second period following the start of the electrification (following the start of the driving of the motor) the temperature is controlled based on using T1 as a reference. At this time, the temperature of the heater 91 does not reach 220° C. in the two seconds following the start of the electrification. However, since a high target temperature is set, the temperature at the heater 91 is elevated easily. That is, warming up the fixing unit becomes easier.

In this case. when the temperature exceeds 140° C., the stained toner transferred to the film 92 is supposed to be gradually returned to the pressurizing roller 93; however, since immediately after the electrification is started the fixing unit is cool, only a small amount of toner is returned to the pressurizing roller 93.

In a period extending from two seconds following to eight seconds following the start of the electrification, the second target control temperature T2 is set to 120° C., and this temperature is maintained for six seconds.

When eight seconds have elapsed following the start of the electrification, i.e., before the recording material P enters the fixing nip N, the temperature is changed to the third target control temperature T3, which is required to fix toner. In this embodiment, the temperature T3 is set to 220° C.

In the pre-rotation temperature control sequence, compared with the first embodiment, the amount of stained toner returned from the film 92 to the pressurizing roller 93 is increased.

However, since the amount of heat supplied to the fixing apparatus (the fixing film unit and the pressurizing roller 93) is increased, the temperature can be raised.

Further, immediately after electrification has begun, control is exercised at a high temperature only for a short period of time, so that the pressurizing roller 93 and the fixing film unit can be heated quickly. However, when the temperature is changed to the second target control temperature T2 (120° C.), which is lower than T, before the stained toner adhered to the film 92 is returned, the fixing apparatus can be heated while the amount of toner returned to the pressurizing roller 93 is reduced.

That is, it is preferable that the control time T1 be changed immediately before toner starts to return to the pressurizing roller 93.

As in the second embodiment, the pre-rotation temperature control sequence is effective for paper, such as a cardboard or an envelope, that has an inferior fixing property.

When the temperature of the pressurizing roller 93 was measured in the same manner as in the second embodiment, in this embodiment it was 85° C. The results obtained by measuring the fixing capability are shown below.

TABLE 5

| | Density reduction rate |
|---|---|
| First embodiment | 16% |
| Third embodiment | 13% |

As is described above, since the pre-rotation temperature control sequence in the third embodiment is employed, the fixing capability can be improved.

When the contamination of the pressurizing roller 93 was measured in the same manner as in the first embodiment, a little toner adhered While 30000 copies were printed; however, this did not actually adversely affect the printing results.

In the third embodiment, the remaining rate for the stained toner that adhered to the film 92 before and after the total pre-rotation temperature control time t1 was 30%.

As is described above, when the time for changing the control temperature in the pre-rotation temperature control sequence is adjusted appropriately, contamination of the pressurizing roller can be prevented while the fixing capability is improved.

So long as the time and the relationship of the remaining rate for the stained toner adhering to the film, as explained in the first embodiment, are satisfied, an arbitrary number of stages may be set for the pre-rotation temperature control sequence.

In this case, it is naturally necessary for the control temperature required to fix toner to be reached when the recording material P has arrived at the fixing nip N.

Furthermore, in the third embodiment, post-heating control may be removed as needed, as in the first embodiment.

Further, when the electrification is started after the driving of the motor has begun, as in the first embodiment, the amount of stained toner returned to the pressurizing roller 93 can be reduced.

In addition, as in the first embodiment, the present invention can be applied for the thermal roller image forming apparatus.

A fixing apparatus that can perform multiple warm-up sequences will now be described.

Fourth Embodiment

In a fourth embodiment, as an example image forming apparatus, a laser beam printer will now be described.

Figure 19:
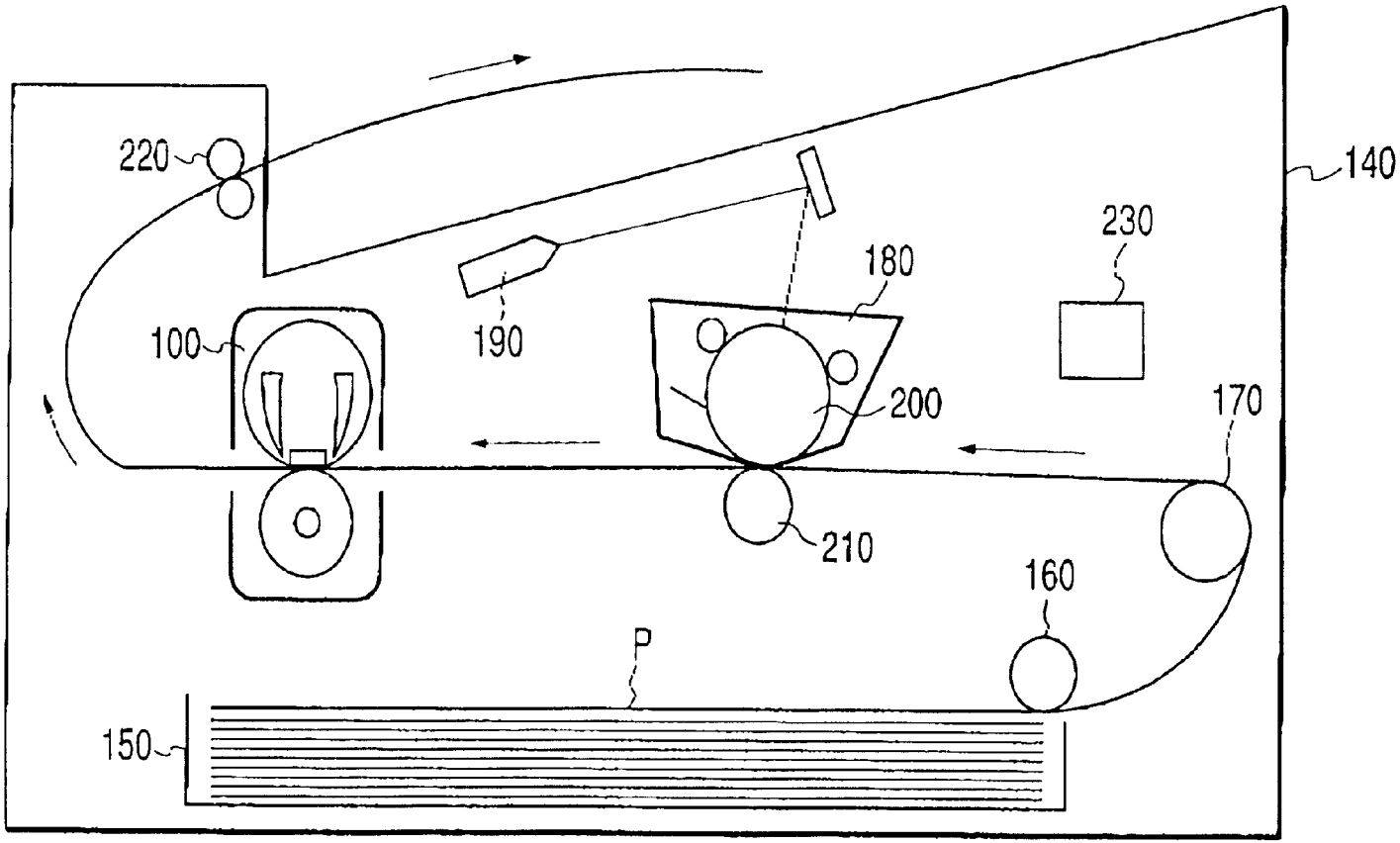
FIG. 19 is a schematic cross-sectional view of a printer comprising a fixing apparatus according to a fourth to a ninth embodiment of the present invention.
Figure 20:
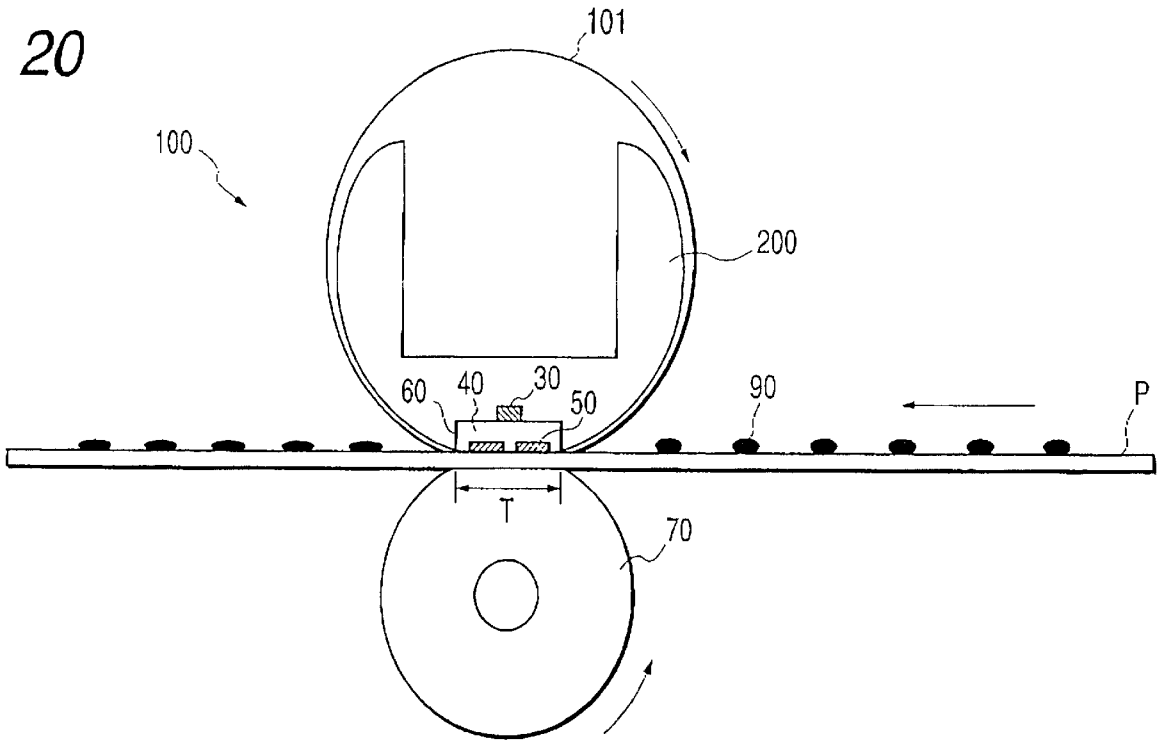
FIG. 20 is a cross-sectional view of a fixing unit mounted in the printer in FIG. 19.

FIG. 19 is a schematic cross-sectional view of an image forming apparatus wherein a fixing apparatus in accordance with the embodiment is mounted. FIG. 20 is a schematic cross-sectional view of the fixing apparatus of the image forming apparatus in FIG. 19. The image forming apparatus is constituted as a laser beam printer, and the feature of the present invention is the control of the temperature of the fixing apparatus mounted thereon.

As is shown in FIG. 19, in the laser beam printer of this embodiment, a process cartridge 180 having a photosensitive drum 200 is located substantially at the center of the printer and is enclosed by an outer housing 140, and a paper cassette 150 in which recording material P, such as paper or OHT, is stored is located below the cartridge 180. The recording material P in the cassette 150 is fed by a paper feeding roller 160, and is conveyed by a conveying roller 170 to the transfer portion of the photosensitive drum 200, An environment sensor 230, arranged to the right of the cartridge 180, detects the temperature and humidity of the environment wherein the printer is installed.

By employing a well known image forming process, the process cartridge 180 forms an image on the photosensitive drum 200. When the photosensitive drum 200 is exposed and scanned by a laser beam emitted by a laser unit 190 outside the cartridge 180, on the surface of the photosensitive drum 200, an electrostatic latent image is formed that is developed by a developing device in the process cartridge 180 to provide a visible toner image.

The toner image formed on the photosensitive drum 200 is transferred to the recording material P, which is conveyed from the cassette 150 to the transfer unit, by a transferring roller 210 located outside the process cartridge 180. The recording material P bearing the toner image is conveyed to a fixing apparatus 100, which fixes the toner image to the recording material P. Then, the recording material P is discharged by discharge rollers 220 to the top of the printer housing 140.

According to this embodiment, a fixing apparatus 100 of a film heating type is employed. As is shown in FIG. 20, a heater 60 is fixed to a heat-resistant stay 20, and a heat-resistant cylindrical thin film (fixing film) 101 is located outside the heater 60 and constitutes a fixing member. Through the film 101, which is the fixing member, an elastic pressurizing roller 70 is pressed against the heater 60 and a fixing nip T, having a predetermined width, is formed between the film 101 and the pressurizing roller 70.

Figure 21:
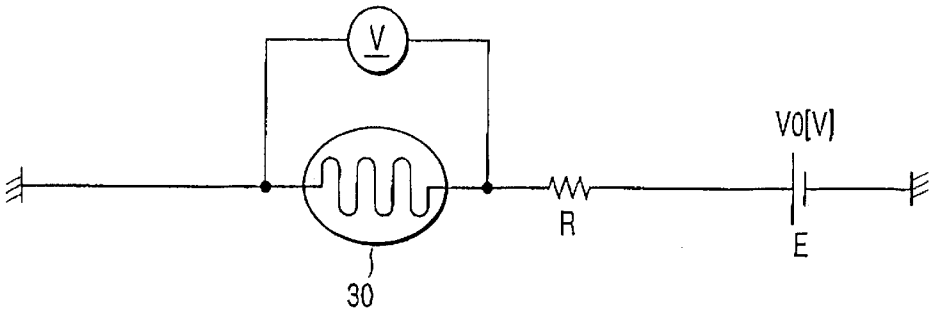
FIG. 21 is a diagram showing a temperature detector in a thermistor.

The heater 60 is designed so that one or multiple lines of heat generation resistors 50 are formed on the surface of a ceramic substrate using screen printing. The heat generation resistors 50 are electrified and heated, and the heater temperature is detected by a thermistor 30, which is temperature detection means, located on the rear face of the heater 60. Based on the detected temperature, the amount of power supplied to the heater 60 (heat generation resistors 50) is controlled, so that the amount of heat generated by the heater 60 can be controlled and a predetermined fixing temperature can be maintained for the heater 60. As is shown in FIG. 21, the thermistor 30 is connected to a voltage detector that includes a direct-current power source P and a resistor R. When a divided predetermined voltage VO, provided by the power source E and obtained through the thermistor resistor, is measured, the output of the thermistor 30 is obtained and the heater temperature can be ascertained.

The fixing film 101 is rotated while coupled with the pressurizing roller 70. The rotational force, exerted against the pressurizing roller 70 in the direction indicated by an arrow, is transmitted to the recording material P at the fixing nip N, and is further transmitted to the fixing film 101. The recording material P is inserted to the fixing nip P from the right in FIG. 20, and as the recording material P advances through the fixing nip N, it closely contacts the fixing film 101, and is held against and conveyed with the film 101 through the fixing nip N. While the recording material P and the fixing film 101 are passing through the fixing nip N, the recording material P and a toner image 90 thereon are heated through the fixing film 101 by the heater 60, whose temperature has reached the fixing temperature, so that the toner image 90 is fixed to the recording material P.

Figure 22:
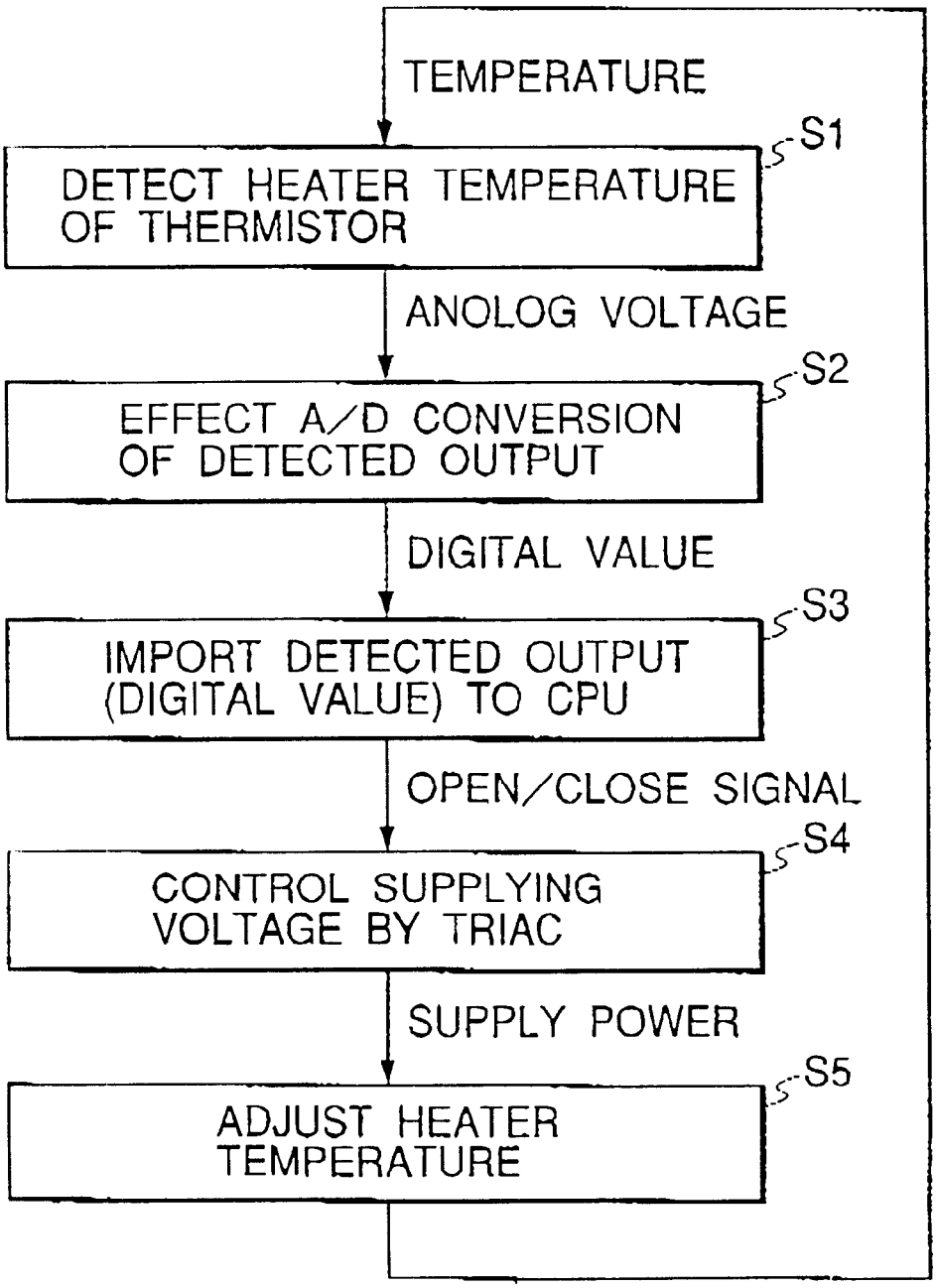
FIG. 22 is a flowchart showing an overview of the temperature control of the fixing unit.

FIG. 22 is a schematic flowchart showing the temperature control process performed by the control means of the fixing apparatus 100. The control means (control circuit) includes a CPU, an A/D converter and a triac.

As is shown in FIG. 22, first, the heater temperature is detected by the thermistor 30 of the heater 60 (step S1), and the analog detection output is converted into a digital value by the A/D converter (step S2). The obtained digital detection output is imported to the CPU (step S3), and based on this, an open/close signal is output to the triac (a voltage supply controller). The triac employs a phase control method or a wave control method to control an AC voltage supplied to the heat generation resistors 50, so that the detected temperature matches the target heater temperature (target fixing temperature) (step S4). The power provided by the adjusted voltage is supplied to the heat generation resistors 50, and the heater 60 is heated to maintain a predetermined heater temperature (step S5).

According to the present invention, for the fixing apparatus 100, multiple modes are prepared that employ different methods to start up the heater 60 since the electrification of the heater 60 was started (start-up) until the recording material P enters the fixing nip, i.e., different temperature control methods are employed to raise the temperature of the heater 60 and to provide a fixing temperature. During the image forming process, the heating mode is selected in accordance with a predetermined selection condition. The heating mode is designated by a user who manipulates an operation panel provided for the printer main body, by a user who manipulates a personal computer, by a printer that automatically designates a mode, or by a combination of these methods.

In this embodiment, two heating modes 1 and 2 are prepared. Heating mode 1 (plain paper mode) is selected for fixing a toner image on a recording material such as thin paper, regular paper or smooth paper (including OHT). Heating mode 2 (thick paper mode) is selected for fixing a toner image on a recording material such as a cardboard or rough surface paper.

Figure 23:
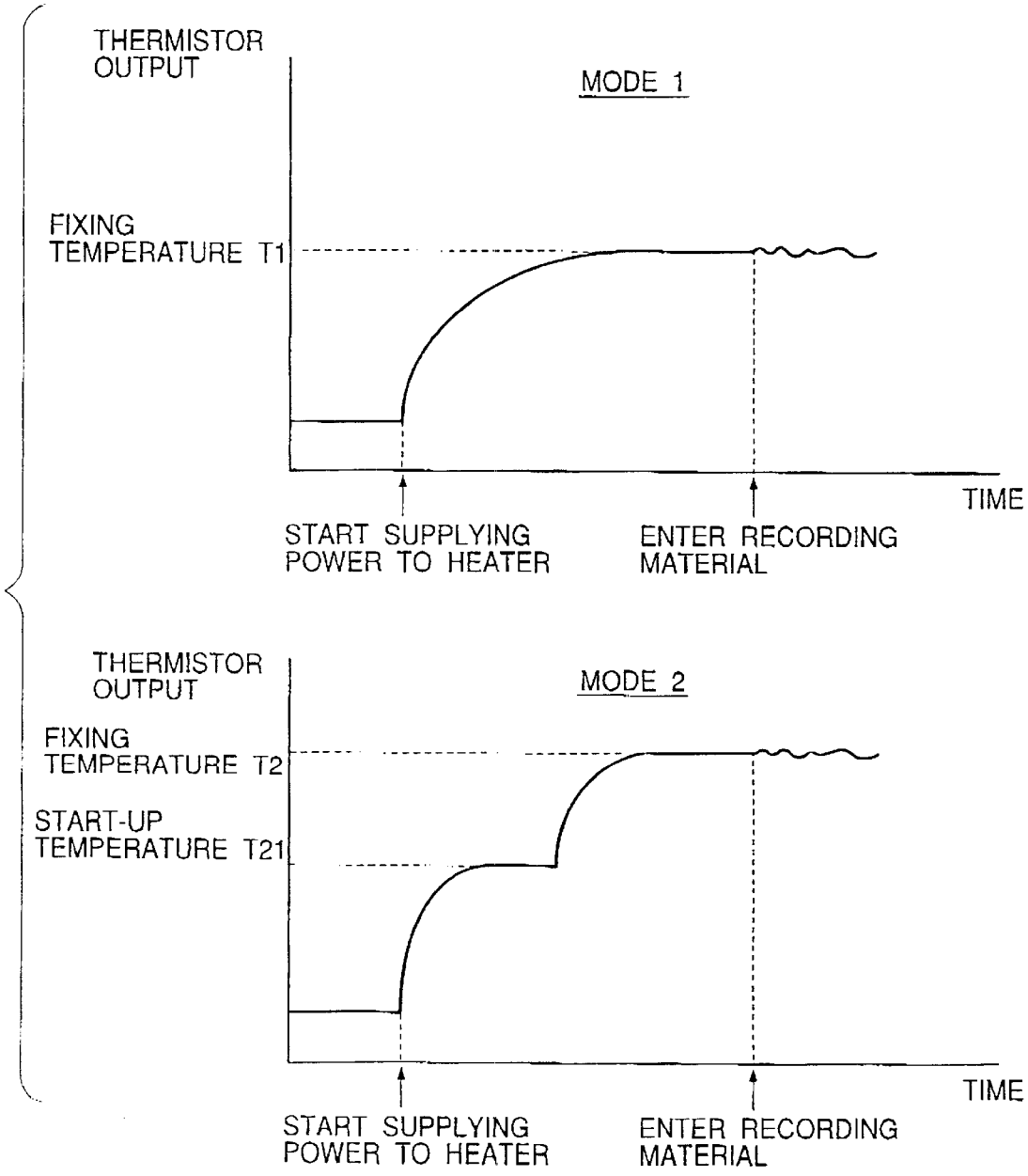
FIG. 23 is a graph showing the temperature control according to the fourth embodiment.

The heating modes for the fixing apparatus in this embodiment are shown in FIG. 23. FIG. 23 is a graph showing the change in the output (analog value) of the thermistor 30 when the rising temperature is controlled by the heating modes of this embodiment. Since the resistance of the thermistor 30 is reduced as the temperature rises, the divided voltage obtained by the thermistor 30 is accordingly reduced. Therefore, the output voltage of the thermistor 30 in FIG. 23 is reduced upward along the vertical axis, and the temperature detected for the heater 60 is raised. The unit along the vertical axis may be either voltage or resistance, or it may be a value recalculated to yield a temperature.

Since the heating mode 2 is selected when the recording material P is thick paper or rough surface paper, a high fixing temperature is required.

Therefore, the fixing temperature T2 is set to T1<T2, relative to the fixing temperature T1, when the heating mode 1 (plain paper mode) is used for a recording material such as thin paper, regular paper or smooth paper.

As is shown in FIG. 23, in the heating mode 1, the is temperature of the heater 60 is raised to the fixing temperature T1 at the first stage Thus, when power is supplied to the heater 60, its temperature is raised to the fixing temperature T1 without stopping. On the contrary, in the heating mode 2, two stages are required to raise the temperature to the fixing temperature T2. When the supply of power to the heater 60 is started, the temperature of the heater 60 is first raised to the temperature T21, and is then raised to the fixing temperature T2.

In this embodiment, since the start-up control method for reaching the fixing temperature is changed and depends on the type of recording material, and since the temperature is raised through multiple stages in order to fix an image to thick paper that requires a higher fixing temperature than regular paper, the start-up control can be exercised while a drastic temperature change is prevented. Therefore, the fixing apparatus and peripheral parts can be prevented from being damaged due to a drastic temperature change, and the service lives of these parts can be extended.

Figure 24:
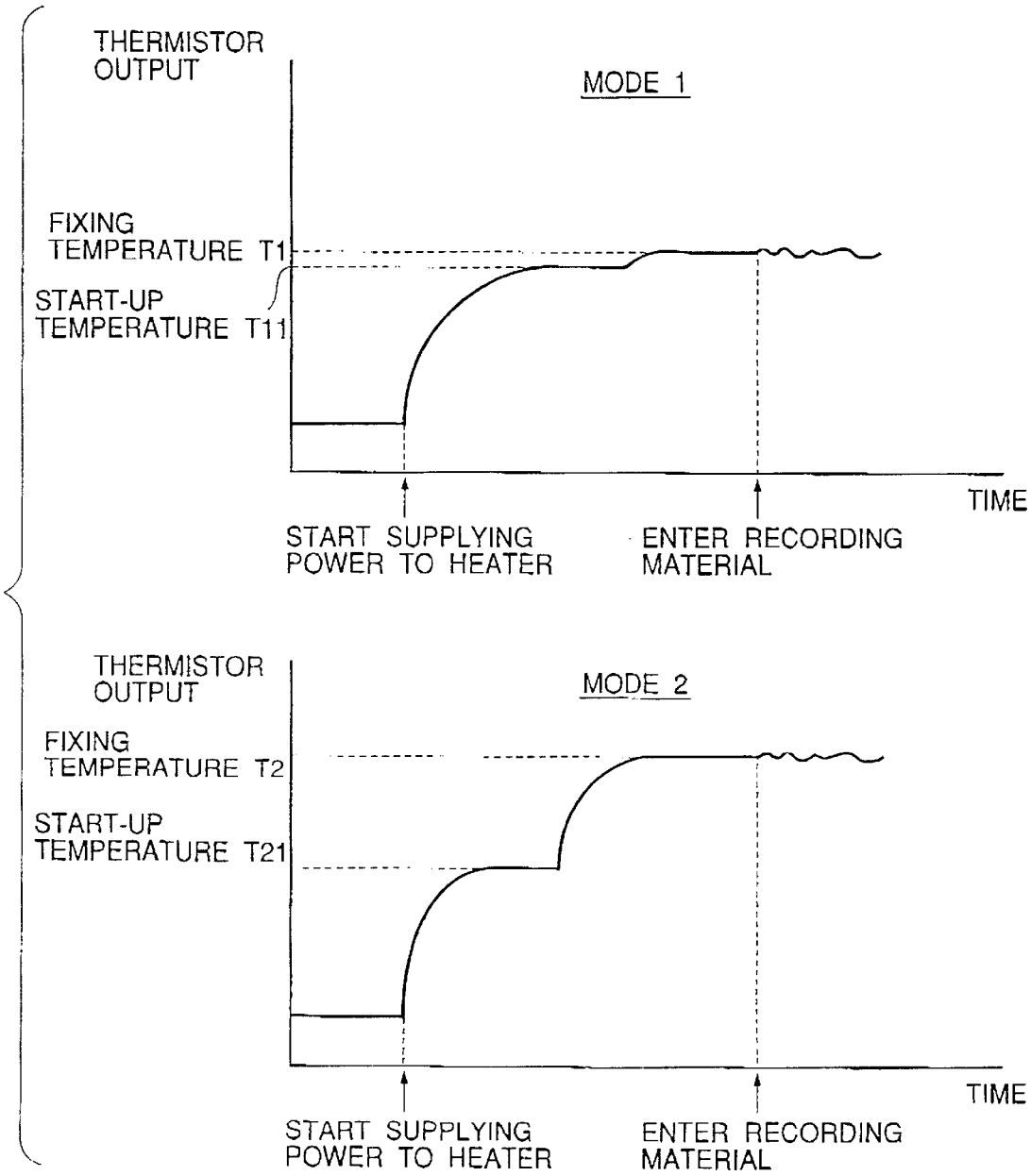
FIG. 24 is a graph showing a modification of the temperature control according to the fourth embodiment.

In the above explanation, while in the heating mode 1 for regular paper a single stage is used for the start-up temperature control, in the heating mode 2 for thick paper two stages are used. However, as is shown in FIG. 24, in the heating mode 1, a start-up temperature T11 may be provided that is slightly lower than the fixing temperature T1, and two start-up stages may be used to reach the fixing temperature T1 from the electrification start for the heater. As is described above, when two start-up stages are used to reach the fixing temperature, a temperature control program can be easily assembled, and this advantage can be obtained not only in mode 2 but also in mode 1.

Fifth Embodiment

Figure 25:
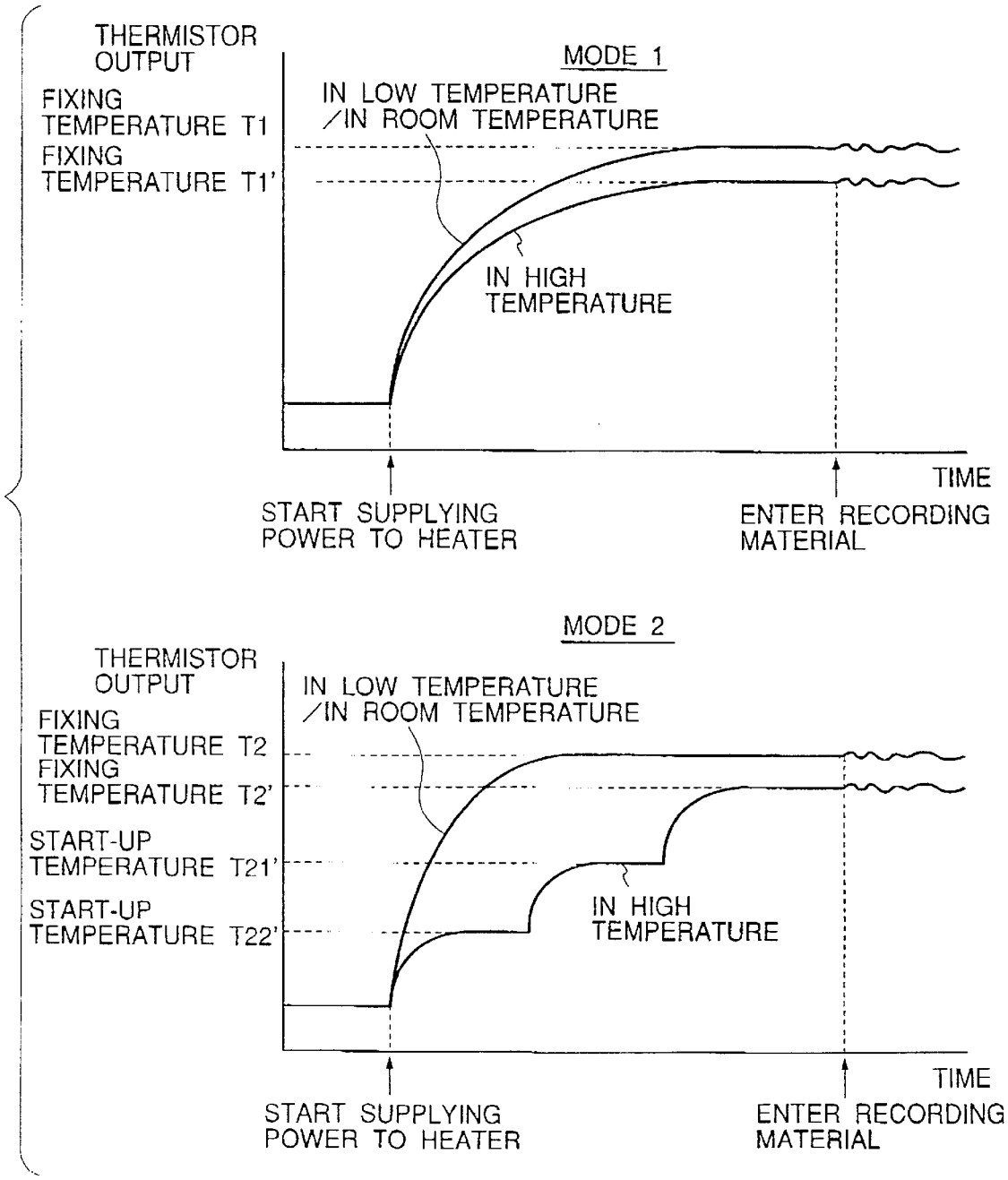
FIG. 25 is a graph showing the temperature control according to the fifth embodiment.

FIG. 25 is a diagram for explaining the heating mode for a fixing apparatus according to a fifth embodiment of the invention.

The heating modes in this embodiment are prepared while taking into account the temperature that is detected by the environment sensor 230 in FIG. 19 for an environment wherein a printer is installed. In FIG. 25, as in FIG. 23, the change in the output (analog value) of a thermistor is shown by the rising temperatures controlled by heating modes.

In FIG. 25, a heating mode 1 (plain paper mode) is selected to fix an image to a recording material such as thin paper, regular paper or smooth paper. When the temperature of the heater is raised to the fixing temperature T1 at a low temperature or at room temperature, since it is assumed that when the environmental temperature is high the ambient temperature of the heater and the temperature of the recording material are also high, the temperature of the heater is raised to a fixing temperature T1' that is lower than T1. In either case, only one stage is used to raise the temperature to the fixing temperature.

A heating mode 2 (thick paper mode) is selected to fix an image to a recording material such as thick paper or rough paper. When the environmental temperature is high, the ambient temperature of the heater and the temperature of the recording material are also high. Therefore, in the thick paper mode, the surface of the pressurizing roller 70 is heated too much before the recording material P enters the fixing nip N, and excessive fixing tends to occur. As a result of excessive fixing, when the toner image on the recording material has passed through the fixing nip N, the toner is still soft and viscous and easily sticks to the fixing film 101. The toner sticking to the fixing film 101 and rotating with the drum 100 then is transferred to the recording material carrying the original toner image and a stained image (a hot offset) is generated.

Therefore, in the heating mode 2, the fixing temperature and the start-up control method differ depending on the environmental temperature. Specifically, at a low temperature or at room temperature, one stage is required to reach the fixing temperature, and at a high temperature, multiple stages are used to reach a fixing temperature T2', which is lower than T1, to prevent a hot offset. In this embodiment, three stages are required to reach the fixing temperature T2', by passing through the start-up temperatures T22' and T21' (T22'<T21').

According to this embodiment, when the printer is used in an environment at a high temperature, fixing an image to thick paper is ensured without a hot offset occurring.

In the above explanation, the heating mode is employed while taking into account the temperature detected by the environment sensor 230 for the environment wherein the printer is set up. However, the heating mode may also be prepared while taking into consideration the humidity detected by the environment sensor 230 for the environment wherein the printer is located. In this case, when a high humidity environment is detected, the start-up control in the heating mode 2 may differ from that in mode 1, as in the above embodiment, in order to prevent the recording material from slipping due to a drastic temperature rise.

Sixth Embodiment

In this embodiment, the start-up control differs depending on the heating mode; and on whether the heater 60 should be electrified at the maximum power produced by a duty ratio of 100%, or whether the temperature of the heater 60 should be raised by reducing the duty ratio. The power is supplied to the heater 60 under wave control, and a synchronization cycle is defined as one of ten half waves.

Figure 26:
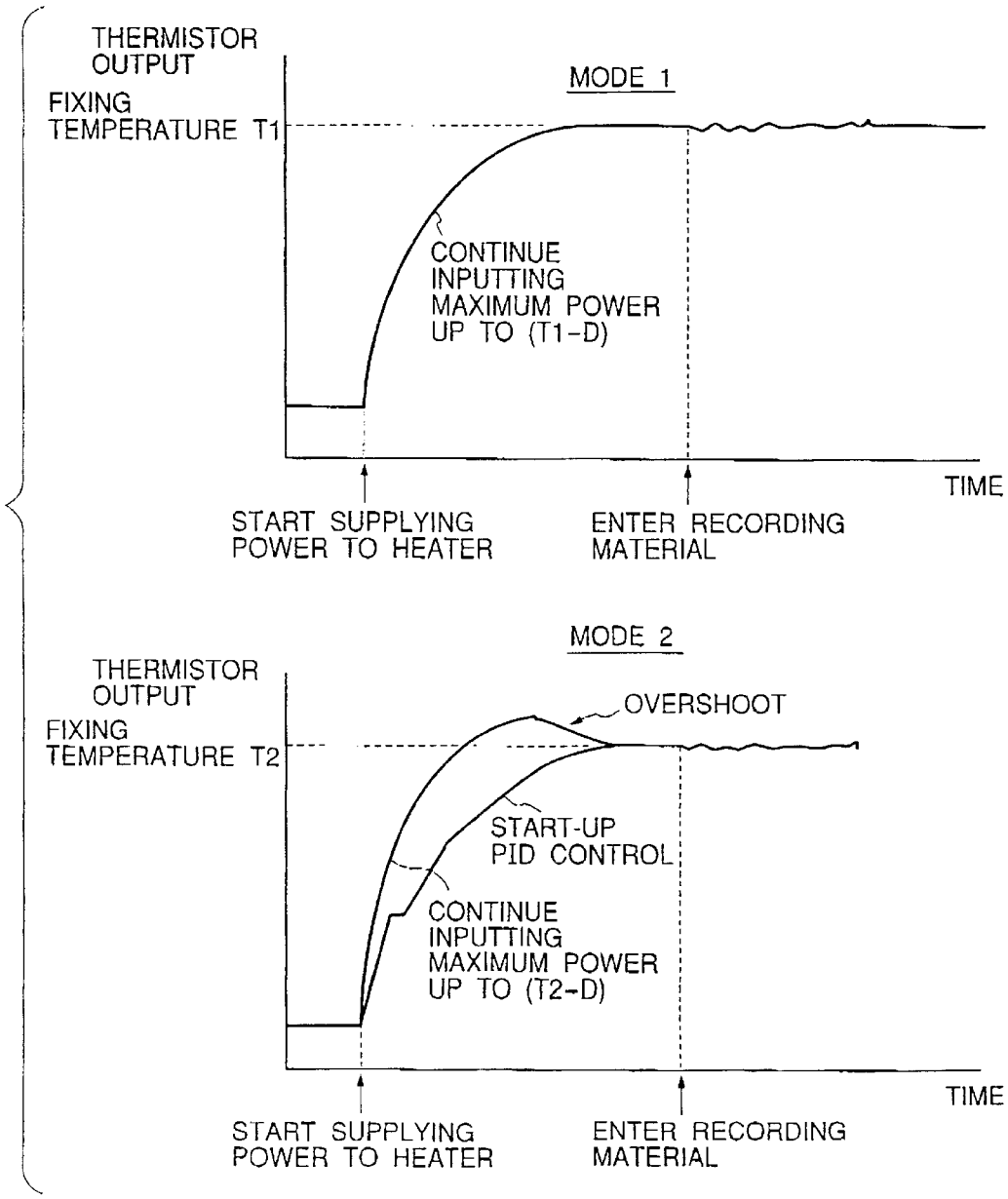
FIG. 26 is a graph showing the temperature control according to the sixth embodiment.

The heating modes of a fixing apparatus for this embodiment are shown in FIG. 26. As in FIG. 23, the change is shown in the output (an analog value) of the thermistor under the start-up temperature control of the individual heating modes.

In FIG. 26, the heating mode (plain paper mode) 1 is used to fix an image to a recording material such as thin paper, regular paper or smooth paper. After power is supplied to the heater 60, at a detected temperature (T1-D) for the thermistor 30, which is lower by a temperature D (° C.) than the fixing temperature T1, the start-up temperature is controlled by inputting the maximum power (the power voltage) of a duty ratio of 100%. When the temperature exceeds (T1-D), the duty ratio is reduced.

A heating mode 2 (thick paper mode) is used to fix an image to a recording material such as thick paper or rough paper. At the same time as the supply of power to the heater 60 is started, the start-up temperature control is performed at a duty ratio that is less than 100% (PID control). Since the temperature is raised slowly in mode 2, at a duty ratio that is smaller than 100%, than in mode 1, for which the maximum power is supplied, a hot offset can be prevented, as in the fifth embodiment.

The fine line in the graph for mode 2 represents a case wherein, as in mode 1, the temperature is raised at the maximum power provided by the duty ratio of 100% until it reaches temperature (T2-D), which is lower by temperature D than the fixing temperature T2, and wherein, when the temperature exceeds (T2-D), the temperature is controlled at a reduced duty ratio until the fixing temperature T2 is reached. In this case, the temperature is raised too high and an overshoot occurs.

In order to obtain satisfactory fixing results on thick paper or rough paper, especially in a low-temperature environment, the image forming apparatus wherein the temperature of the fixing apparatus is determined employs a heating mode having a high fixing temperature. Further, when the temperature is high and the maximum power is also high, an rover shoot and a hot offset tend to occur. Therefore, to prevent the overshoot, a start-up temperature control must be devised, such as a method that uses multiple stages to raise the temperature. Thus, as in mode 2 of this embodiment, when the temperature is raised at a small duty ratio that is less than 100%, the overshoot can be prevented.

Seventh Embodiment

In a seventh embodiment, start-up temperature control is performed in two stages in heating mode 1 in which the fixing temperature is lower.

Figure 27:
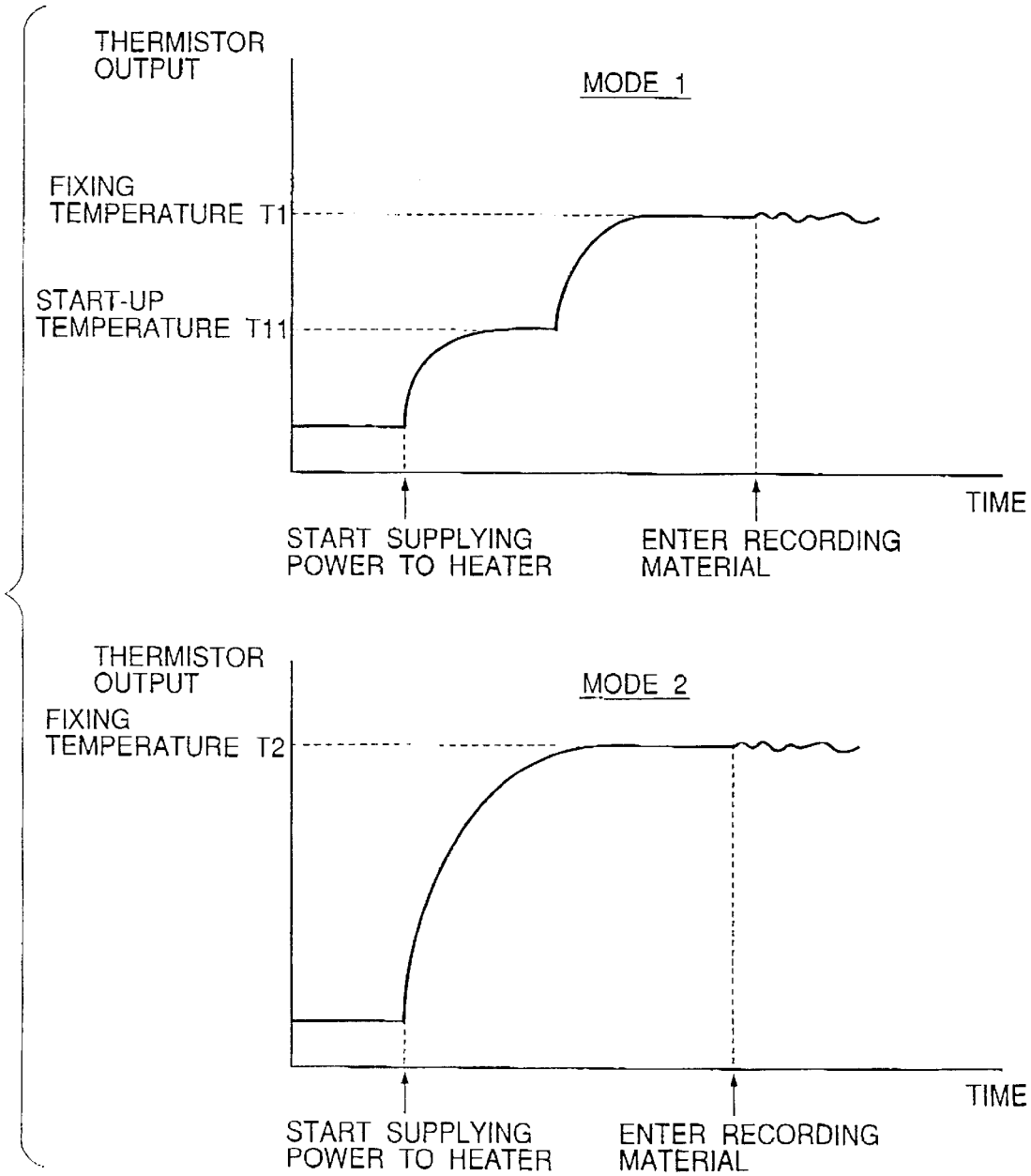
FIG. 27 is a graph showing the temperature control according to the seventh embodiment.

In FIG. 27, heating mode 1 (plain paper mode) is used to fix an image to thin paper, regular paper and smooth paper. In mode 1, to prevent an overshoot, the temperature is first raised to the start-up temperature T11, and after the temperature has leveled off, it is raised to the fixing temperature T1.

A heating mode 2 (thick paper mode) is used to fix an image to a recording material such as thick paper or rough paper. In mode 2 of this embodiment, satisfactory image fixing is regarded as the most important, and after power has been supplied to the heater, in one stage the temperature is raised to the fixing temperature T2.

When the entire fixing apparatus is cooled in a low-temperature environment, the acquisition of satisfactory image fixing is determined depending on how long before the recording material enters the fixing nip N the temperature of the pressurizing roller 70 can be raised. Therefore, to fix an image to quite thick paper in a low-temperature environment, raising the temperature to the fixing temperature T in two stages is not appropriate, and the maximum power should be used to raise, at one time, the temperature to the fixing temperature T2.

In this embodiment, satisfactory fixing results can be obtained when a quite thick recording material is used in a low-temperature environment.

Eighth Embodiment

An explanation will now be given for an eighth embodiment having heating modes that ensure the fixing of a recording material within a short period of time.

Figure 28:
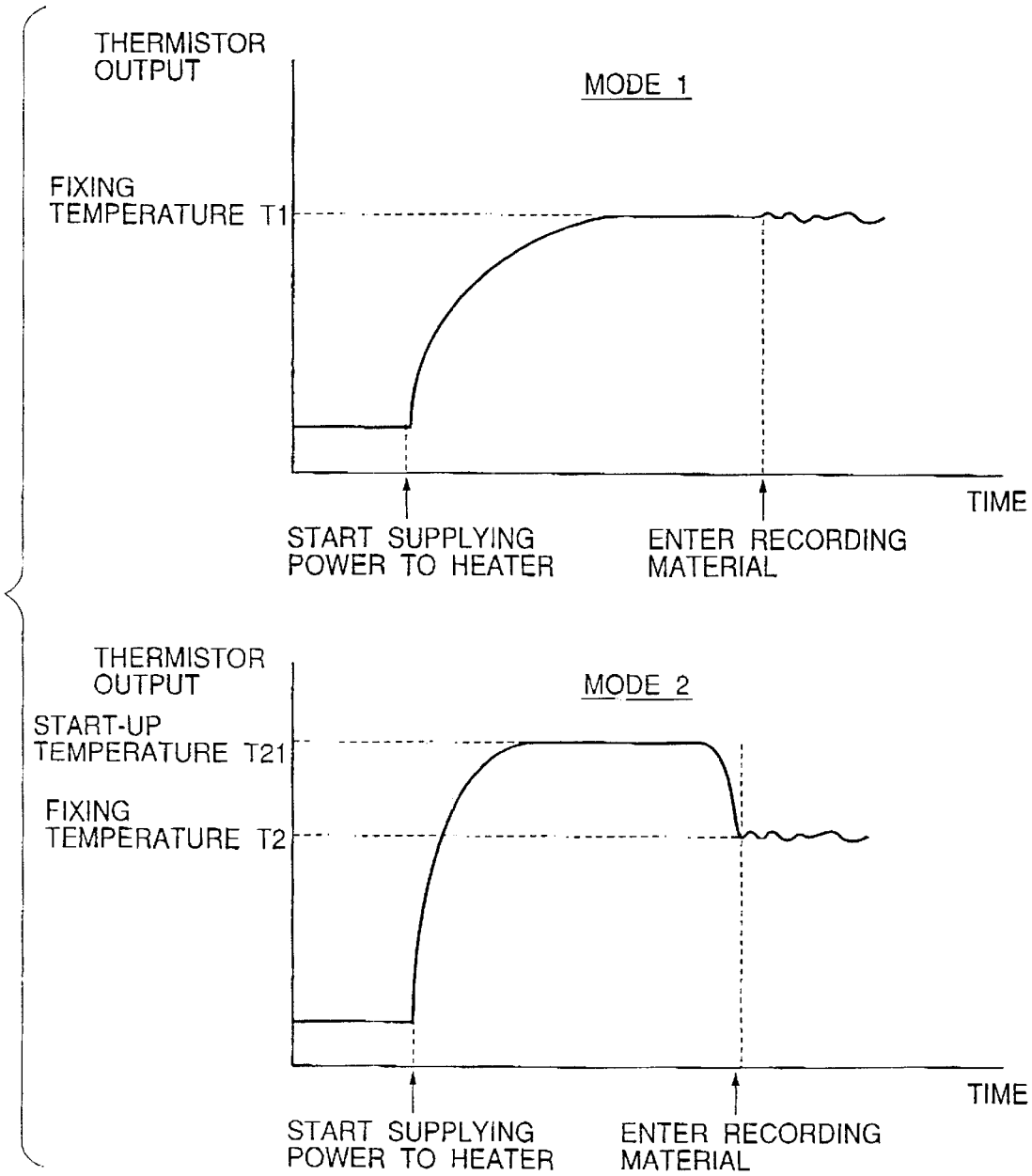
FIG. 28 is a graph showing the temperature control according to the eighth embodiment.

In FIG. 28, a heating mode 1 (plain paper mode) is used to fix an image to a recording material such as thin paper, regular paper or smooth paper. A heating mode 2 (thick paper mode) is used to fix an image to a recording material such as thick paper or rough surface paper. In mode 1, the temperature is raised at one time to the fixing temperature T1, while in mode 2, the temperature is raised at one time to a temperature T21, higher than the fixing temperature T2, and subsequently, after this temperature T21 has been maintained for a while, it is reduced to the fixing temperature T2, synchronized with the entry into the fixing nip of the recording material.

Since such temperature control is performed in mode 2, the temperature of the pressurizing roller 70 can be set high, even when the same time is required from the time power is supplied to the heater 60 until the recording material enters the fixing nip. Therefore, for thick paper or rough surface paper processed in mode 2, image fixing can be satisfactorily performed, from the beginning.

Specifically, this method is appropriate for a case wherein, at the start in a cool state (a cold start) of the supply of power to the heater of the entire fixing apparatus, satisfactory fixing must be obtained for the first recording material within the same start-up time as in mode 1, used for thin paper or OHT (smooth paper).

This is because, to ensure adequate image fixing, an increase in the fixing temperature is not sufficient. Considerable heat is required for the pressurizing roller, and when the recording material has entered the fixing nip, the toner must also be heated from the non-printing side (the rear surface) of the a recording material. Otherwise, the temperature of the pressurizing roller would be drastically reduced during the fixing performed for the first sheet, and deterioration the latter half of the first sheet would occur.

It should be noted, however, that when in heating mode 1 the same process is performed for thin paper or OHT, in a very humid environment the recording material may slip.

Ninth Embodiment

In a ninth embodiment, barrier countermeasure modes for the pressurization roller stained by toner are prepared as heating modes.

As one of barriers that accompany the use of the fixing apparatus, a block of toner may be adhered to the pressurizing roller 70 and transferred to the recording material. One cause of this phenomenon is that toner adheres to the fixing film 101 when a toner image is fixed. And when under start-up temperature control there is a drastic supply of power to a heater, the temperatures of the heater and the pressurizing roller 70 will be increased suddenly, and it is assumed that toner on the fixing film 101 will be transferred to the pressurizing roller 70. Thereafter, as a result of a repetitive process, a block of toner will finally be formed on the pressurizing roller.

Thus, in addition to the regular paper mode 1 and the thick paper mode 2 used for normal image fixing, a heating mode 3, a modification of mode 2, is prepared in which the temperature of the heater is gradually raised to prevent the accumulation of stained toner on the pressurizing roller.

Figure 29:
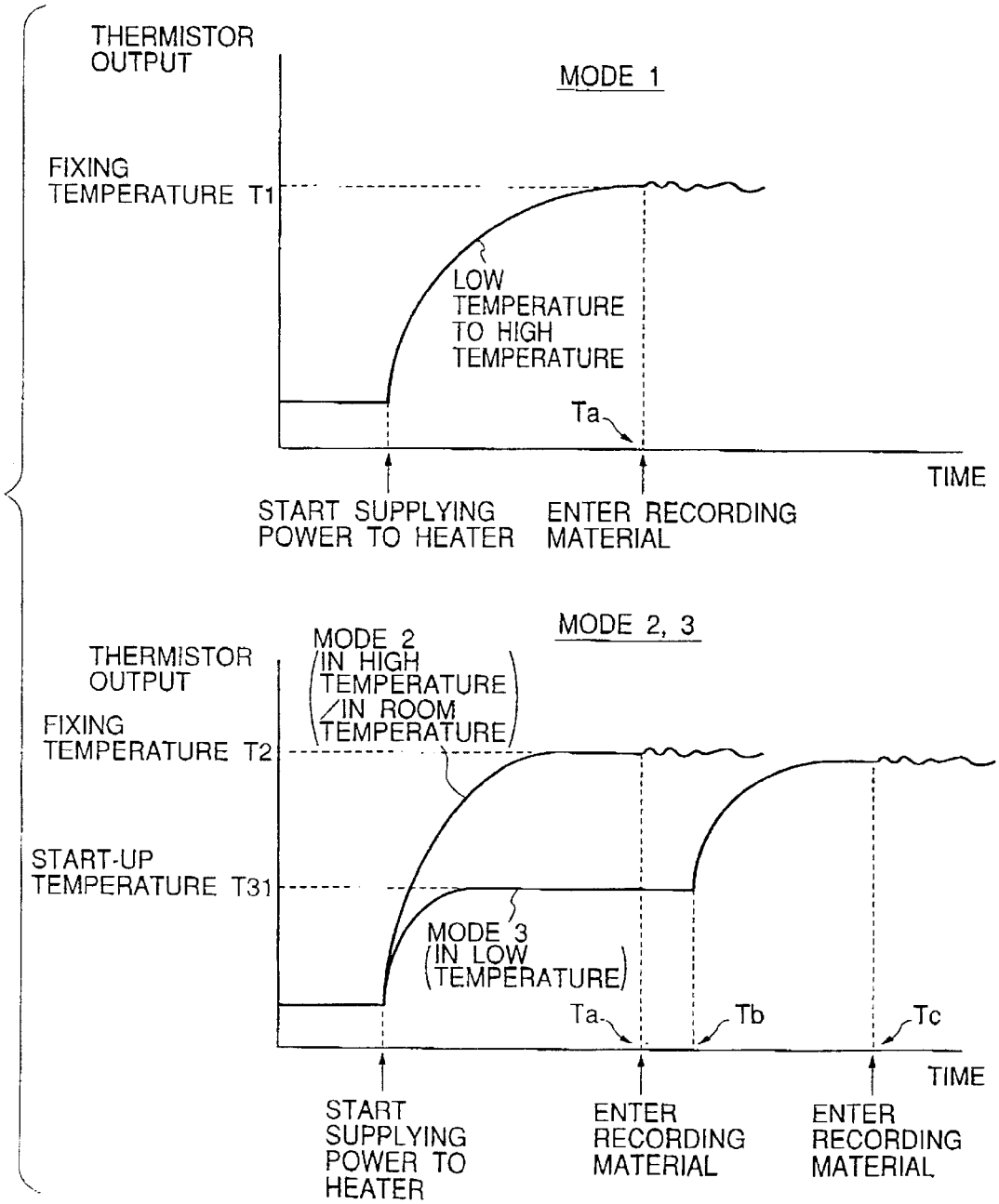
FIG. 29 is a graph showing the temperature control according to the ninth embodiment.

In FIG. 29, the only difference between heating mode 2 and heating mode 3 is the start-up temperature control. And even when mode 2 is selected, once the environment sensor 230 detects a temperature equal to or lower than a threshold value, mode 2 is automatically changed to the node 3. This occurs because, due to a temperature difference, when the fixing temperature and the start-up time are determined, a start-up from a low temperature is more drastic than is a start-up from one at or around room temperature. Thus, in order to prevent a drastic rise, there is a shift to mode 3 whereby the temperature of the heater is raised gradually.

While in some of the previous embodiments multiple start-up temperatures are prepared to raise the heater temperature, in this embodiment, the start-up period of time is extended so that the heater temperature can be raised gradually.

In FIG. 29, when mode 2 is selected and the environment sensor 230 detects a temperature equal to or higher than the room temperature, the heater temperature is raised to the fixing temperature T1 within the same start-up time Ta in mode 1, which is not affected by the environmental temperature, and the recording material is inserted into the fixing nip.

When mode 2 is selected and the environment sensor 230 detects a temperature lower than room temperature, there is a shift from mode 2 to mode 3. Then, after the supply of power to the heater is started, the heater temperature is raised to a start-up temperature T31, which is lower than the fixing temperature T2. That temperature is then maintained for a while until time Tb (Tb>Ta), and is raised to the fixing temperature T2 at a time Tc, which permits permit the recording material to enter the nip N. As is described above, since a start-up temperature T31 that is lower than the fixing temperature T2 is provided and is maintained for the heater, the start-up time required for the fixing temperature T2 to be reached is extended.

It should be noted, however, that the mode 2 is automatically shifted to the mode 3 when the temperature is near the environmental temperature detected by the fixing apparatus (a cold start). For example, when the printing process is started as soon as the preceding printing has been completed (intermittent printing), the fixing apparatus is warmed by the heat generated during the previous printing, so that the effects obtained by shifting from mode 2 to mode 3 are reduced.

In this embodiment, as is described above, since a start-up temperature lower than the fixing temperature is set to extend the start-up time, a drastic temperature rise to the fixing temperature can be prevented, and the pressurizing roller can be protected from being stained by toner.

Figure 30:
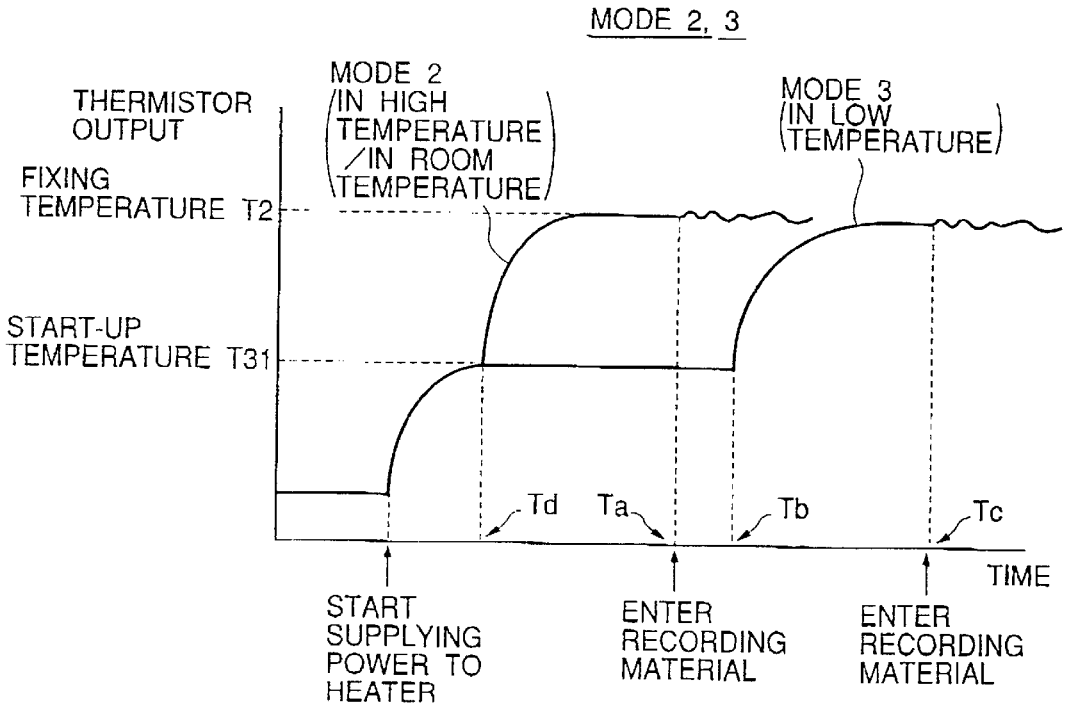
FIG. 30 is a graph showing a modification of the temperature control according to the ninth embodiment.

In the above embodiment, three start-up stages are employed for mode 3. As is shown in FIG. 30, however, in mode 2, two start-up stages can be employed; and at time Td. the heater temperature is raised to the start-up temperature T31, which is lower than the fixing temperature T2, and is further raised to the fixing temperature T2 at time Ta. When the fixing temperature is reached using two start-up stages, the temperature control program can be easily assembled.

In the above embodiment, a fixing apparatus of a film heating type has been used. However, a fixing apparatus of a heating roller type may be employed wherein a fixing nip is formed by bringing an elastic pressurizing roller into contact with a fixing roller incorporating a heater. When the present invention is employed in the same manner, the same effects can be obtained. The present invention, however, is not limited to these embodiments, and can also include modifications based on the same technical concepts.

What is claimed is:

1. An image fixing apparatus for fixing an image formed on a recording material, comprising:

a heating member;

a back-up roller cooperating with said heating member to form a nip therebetween for conveying the recording material; and control means for controlling generation of heat by said heating member;

wherein said control means is capable of effecting first control for permitting said heating member to generate heat in a state where an image fixing process is completed and said back-up roller is stopped, and second control for maintaining said heating member at a target temperature, differing from a fixing temperature, during a warm-up period from when said heating member starts to generate heat until the temperature of said heating member reaches the fixing temperature.

2. An image fixing apparatus according to claim 1, wherein said image fixing apparatus is mounted in a printer for forming an image on the recording material, and wherein said heating member does not generate heat in a stand-by state when waiting for an input or a print signal, and starts to generate heat upon receiving the print signal.

3. An image fixing apparatus according to claim 1, wherein the image on the recording material is formed of toner, and wherein the temperature of said heating member in the first control is equal to or higher than a softening point of the toner.

4. An image fixing apparatus according to claim 1, wherein the image on the recording material is formed of toner, and wherein the target temperature in the second control is equal to or lower than the softening point of the toner.

5. An image fixing apparatus according to claim 1, wherein said control means continues the second control until immediately before the recording material enters the nip.

6. An image fixing apparatus according to claim 5, wherein the second control is performed during a predetermined period of time.

7. An image fixing apparatus according to claim 1, wherein said control means sets the second control, in accordance with a kind of recording material.

8. An image fixing apparatus according to claim 7, wherein, when the recording material is a thick paper or an envelope, said control means sets multiple target temperatures and executes the second control.

9. An image fixing apparatus according to claim 1, further comprising a film that moves with the recording material while contacting said heating member, wherein the image on the recording material is heated by a heat from said heating member via said film.

10. An image fixing apparatus according to claim 1, wherein said heating member is shaped like a rotary member, and wherein the image on the recording is heated by a heat from said heating member.

11. An image fixing apparatus for fixing a toner image formed on a recording material, comprising:

a heating member;

a back-up roller cooperating with said heating member to form a nip therebetween for conveying the recording material;

control means for controlling generation of heat by said heating member, wherein said control means is capable of effecting control for maintaining said heating member at a target temperature, differing from a fixing temperature, during a warm-up period from when said heating member starts to generate heat until the temperature of said heating member reaches the fixing temperature, and wherein the target temperature is a temperature such that, during a period where said heating member is maintained at the target temperature, 70% or more of the toner, which is remained on said heating member and is not transferred to said back-up roller, is present.

12. An image fixing apparatus according to claim 11, wherein, when the warm-up period is denoted by t1 and a period for temperature control at the target temperature is denoted by t2, the relationship $t2 \geqq t1 \times 0.4$ is satisfied.

13. An image fixing apparatus according to claim 11, wherein said image fixing apparatus is mounted in a printer for forming an image on the recording material, and wherein said heating member does not generate heat in a stand-by state when waiting for an input of a print signal, and starts to generate heat upon receiving the print signal.

14. An image fixing apparatus according to claim 11, wherein the target temperature is equal to or lower than a softening point of the toner.

15. An image fixing apparatus according to claim 11, further comprising, a film that moves with the recording material while contacting said heating member, wherein the image on the recording material is heated by a heat from said heating member via said film.

16. An image fixing apparatus according to claim 11, wherein said heating member is shaped like a rotary member, and wherein the image on the recording material is heated by a heat from said heating member via said film.

17. An image fixing apparatus for fixing an toner image formed on a recording material, comprising:

a heating member;

a back-up roller cooperating with said heating member to form a nip therebetween for conveying the recording material; and control means for controlling generation of heat by said heating member, wherein said control means is capable of effecting control for maintaining said heating member at a target temperature, differing from a fixing temperature, during a warm-up period from when said heating member starts to generate heat until the temperature of said heating member reaches the fixing temperature, and wherein 20% or more of the toner adhered to said heating member before a start of the warm-up period remains on said heating member at an end of the warm-up period.

18. An image fixing apparatus according to claim 17, wherein, when the warm-up period is denoted by t1 and a period for temperature control at the target temperature is denoted by t2, the relationship $t2 \geqq t1 \times 0.4$ is established.

19. An image fixing apparatus according to claim 17, wherein said image fixing apparatus is mounted in a printer for forming an image on the recording material, wherein said heating member does not generate heat in a stand-by state when waiting for an input of a print signal, and starts to generate heat upon receiving the print signal.

20. An image fixing apparatus according to claim 17, wherein the target temperature is equal to or lower than a softening point of the toner.

21. An image fixing apparatus according to claim 17, further comprising a film that moves with the recording material while contacting said heating member, wherein the image on the recording material is heated by a heat from said heating member via said film.

22. An image fixing apparatus according to claim 17, wherein said heating member is shaped like a rotary member, and wherein the image on the recording material is heated by a heat from said heating member via said film.

* * * * *

UNITED STATES PATENT AND TRADEMARK OFFICE

CERTIFICATE OF CORRECTION

PATENT NO. : 6,516,166 B2
DATED : February 4, 2003
INVENTOR(S) : Hiroyuki Sakakibara et al.

It is certified that error appears in the above-identified patent and that said Letters Patent is hereby corrected as shown below:

Drawings,
Sheet 14, Figure 22, “ANOLOG” should read -- ANALOG --.

Column 2,
Line 9, “requiring” should read -- requires --.

Column 4,
Line 26, “wherein.” should read -- wherein, --.

Column 6,
Line 15, “N.” should read -- N, --.
Line 46, “heat-resistant-base” should read -- heat-resistant base --.

Column 7,
Line 40, “seconds” should read -- seconds. --.

Column 9,
Line 51, “roller 93.” should read -- roller. --.

Column 11,
Line 24, “begin,” should read -- begun, --.

Column 12,
Line 20, “when” should be deleted.

Column 14,
Line 43, “case.” should read -- case, --.

Column 16,
Line 59, “source P” should read -- source E --.

Column 18,
Line 5, “the is” should read -- the --.

Column 20,
Line 13, “rover shoot” should read -- overshoot --.

UNITED STATES PATENT AND TRADEMARK OFFICE

CERTIFICATE OF CORRECTION

PATENT NO. : 6,516,166 B2
DATED : February 4, 2003
INVENTOR(S) : Hiroyuki Sakakibara et al.

It is certified that error appears in the above-identified patent and that said Letters Patent is hereby corrected as shown below:

Column 21,
Line 19, “the a” should read -- the --.

Column 22,
Line 36, “Td.” should read -- Td, --.

Column 23,
Line 7, “or” should read -- of --.

Column 24,
Line 13, “comprising,” should read -- comprising --.
Line 21, “an” should read -- a --.

Signed and Sealed this

Twenty-eighth Day of October, 2003

JAMES E. ROGAN
*Director of the United States Patent and Trademark Office*